US006792620B2

(12) United States Patent
Green

(10) Patent No.: US 6,792,620 B2
(45) Date of Patent: Sep. 21, 2004

(54) GARMENT SECURED BY LOCK AND GARMENT CLOSURE SYSTEM AND METHOD

(76) Inventor: Alison Green, 155 W. 68th St., #523, New York, NY (US) 10023

( * ) Notice: Subject to any disclaimer, the term of this patent is extended or adjusted under 35 U.S.C. 154(b) by 299 days.

(21) Appl. No.: 09/861,178

(22) Filed: May 18, 2001

(65) Prior Publication Data

US 2002/0042937 A1 Apr. 18, 2002

Related U.S. Application Data

(60) Provisional application No. 60/205,111, filed on May 18, 2000, and provisional application No. 60/246,068, filed on Nov. 7, 2000.

(51) Int. Cl.[7] ..... A41D 1/00

(52) U.S. Cl. ..... 2/69; 2/67

(58) Field of Search ..... 2/69, 69.5, 73–75, 2/78.1–78.4, 79, 80, 83, 88, 93, 96, 102–109, 113–115, 211, 219, 400–408, 227, 228, 234–236, 238, 311, 312, 336, 338, 244, 243.1; D2/700–702, 705, 718, 720, 728, 731, 734, 738, 750, 753, 756, 794, 797, 803, 806, 833, 840, 844, 847, 853, 624, 639

(56) References Cited

U.S. PATENT DOCUMENTS

| | | | | | |
|---|---|---|---|---|---|
| 407,919 | A | | 7/1889 | Blum | |
| 2,626,395 | A | * | 1/1953 | Whitman | 450/1 |
| 2,715,225 | A | | 8/1955 | Gould | |
| 2,783,759 | A | * | 3/1957 | Hill | 2/159 |
| 2,896,630 | A | | 7/1959 | Adler | |
| 4,028,740 | A | * | 6/1977 | Luerken | 2/67 |
| 4,440,174 | A | | 4/1984 | Cordova | |
| 4,575,873 | A | * | 3/1986 | Smith | 2/227 |
| 4,599,751 | A | * | 7/1986 | Bouwhuis | 2/400 |
| 4,819,465 | A | | 4/1989 | Stanich | |
| 4,882,918 | A | | 11/1989 | Stanich | |
| 4,899,560 | A | | 2/1990 | Chen | |
| 5,016,284 | A | * | 5/1991 | Brown | 2/69 |
| 5,368,050 | A | | 11/1994 | Donelan | |
| 5,485,636 | A | * | 1/1996 | Yandell | 2/406 |
| 5,613,251 | A | | 3/1997 | Yandell | |
| D401,836 | S | | 12/1998 | Chuang | |
| 5,991,920 | A | * | 11/1999 | Holland | 2/67 |
| 6,009,556 | A | * | 1/2000 | Nenninger | 2/67 |
| 6,024,091 | A | | 2/2000 | Bennett | |
| 6,149,496 | A | | 11/2000 | Fildan | |
| D434,635 | S | | 12/2000 | Ruan | |
| 6,174,217 | B1 | | 1/2001 | Judson | |

FOREIGN PATENT DOCUMENTS

| | | |
|---|---|---|
| IT | 590134 | 3/1959 |

OTHER PUBLICATIONS

PCT International Search Report dated Nov. 16, 2001.

* cited by examiner

*Primary Examiner*—Gloria M. Hale

(57) ABSTRACT

The clothing of the invention is held together at a single point of closure, at a single main point of closure, or at several points of closure by a locking device or devices in such a way that unlocking the locking device(s) renders the garment removable from the wearer's body.

17 Claims, 36 Drawing Sheets

FIG. 8
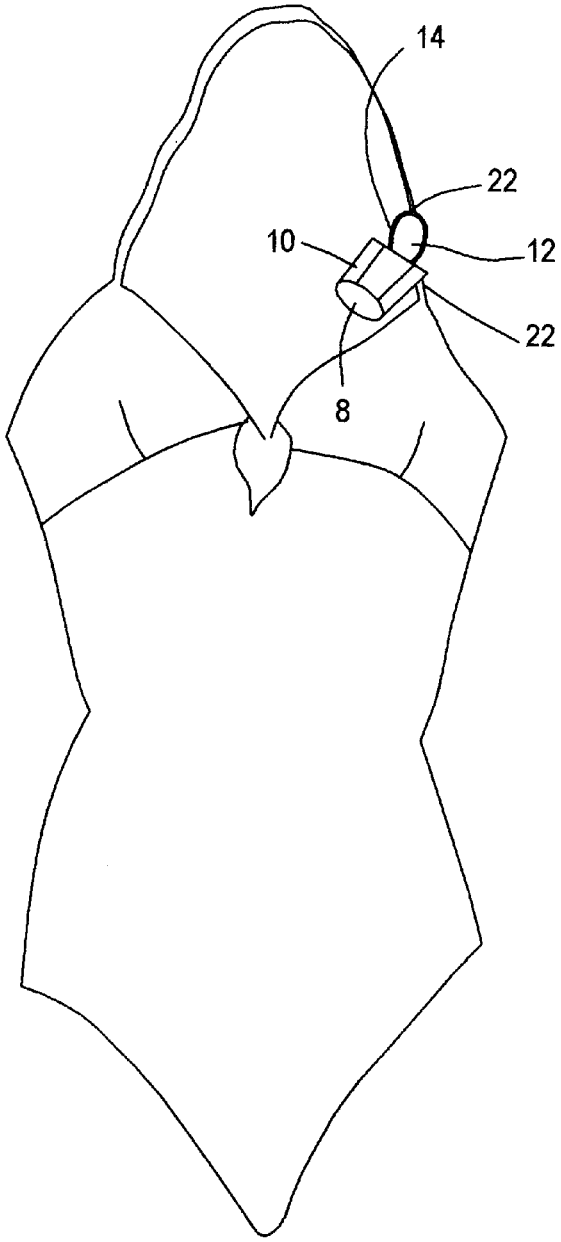
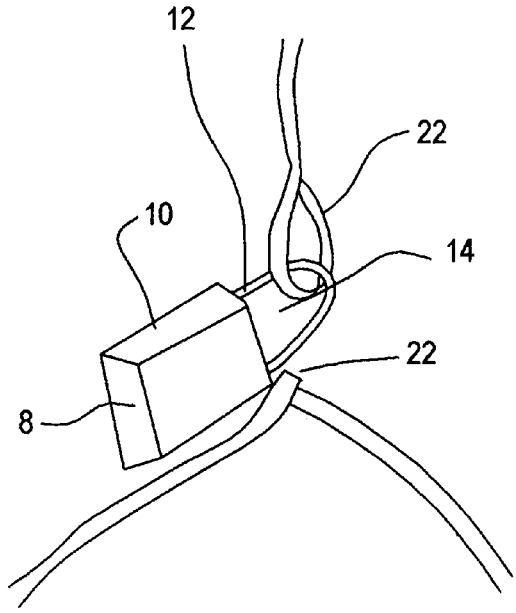
FIG. 9

GARMENT SECURED BY LOCK AND GARMENT CLOSURE SYSTEM AND METHOD

Applicant hereby claims the benefit of the following two provisional patent applications, which are hereby incorporated by reference herein in their entireties:

provisional application Ser. No. 60/205,111, filed May 18, 2000, titled "Clothing Held by a Lock"; and provisional application Ser. No. 60/246,068, filed Nov. 7, 2000, titled "Garment Closure System and Method. "

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND

The present invention relates to clothing having one or more points of closure, where at least one such point of closure is secured with a lock.

Clothing has always been held on the body via closures such as zippers or buttons or has been cut in such a way that it can be put on and taken off the body without the need for closures, such as, for example, dresses that are put on and taken off over the head or workout pants held on the waist by elastic. These are the standard, accepted ways of putting on and taking off clothes, and even the haute fashion designers have not, throughout the long and glamorous history of fashion, introduced any alternative ways of putting on or taking off their creations.

The present invention provides an alternative adventuresome, comfortable and provocative way of putting on, wearing, and taking off clothes.

SUMMARY OF THE INVENTION

In accordance with the invention, an article of clothing of the present invention is held together at a single point of closure, or at a single main point of closure, or at several points of closure by a locking device in such a way that unlocking the locking device results in the clothing opening or falling away from the body.

As used herein, the term "closure" includes any part or parts of a garment or other article of clothing that can be joined in a releasable fashion, e.g., the closure can be opened. When two parts of a piece of clothing are releasably joined, the closure is said to be "secure" or "secured." Typically, opening a closure renders an article of clothing easier to remove. As used herein, a single point of closure indicates that, in addition to the locking mechanism, a garment or other clothing is not held on the body by any additional closure means, such as buttons, zippers, snaps, etc. As used herein, a single main point of closure indicates that the garment may have closure means, such as snaps, in addition to the locking device. As used herein, several points of closure indicate that the garment has several closure points at least two of which are held together by a locking mechanism. However, in all embodiments of the present invention, a garment is not held on and in place on the body unless the locking device(s) is fastened and locked, such that unlocking the locking device(s) causes the garment to open or fall away from the body.

The locking device, which is preferably a lock, must be secured in order for the garment or other clothing to stay on and in place on the body. In accordance with the invention, clothing encompasses all types of garments, such as, for example, lingerie, bathing suits, pants, jackets, tops, dresses, skirts and evening wear for men and women. Articles of clothing as used herein further includes accessories worn on the body such as belts, footwear shoes, sandals, boots, scarves, shawls, ties, capes, hats and the like. The locking device facilitates the ease and speed of putting on and taking off all such articles of clothing and creates a fun, adventuresome and provocative way of wearing clothes.

Preferably, the locking device is a lock of a variety of shapes and sizes, such as, for example, a small heart shaped lock, a cylindrical, square or oval lock, or any other geometrically or otherwise shaped lock or combination of locks. The lock can be monogrammed with the designer's initials or otherwise engraved to enhance the appeal and recognition of the clothes. As used herein, the term "lock" means any first device that can be used to secure a closure and that requires a second device or piece of information (a "key") to be opened. Examples of a lock include a key padlock, a rotary combination lock, a multi-rotor combination lock, an electronic lock, etc. An example of a three-rotor multi rotor combination lock is the Model 620 and the Model 1544 Padlocks manufactured by the Master Lock Company, 2600 North 32$^{nd}$ Street, Milwaukee, Wis. 53210-0367. An example of a key padlock is the Model 3115 padlock manufactured by the Master Lock Company. An example of a rotary combination lock is the Model 1500 padlock made by the Master Lock Company. These illustrate examples of types of locks suitable for use in accordance with embodiments of the present invention. The size of the locks used with a garment in accordance with the present invention should typically be small (in some cases, smaller than the cited Master Lock Company model numbers) so as to be effective and yet relatively unobtrusive.

As used herein, the term "key" means any device or information needed to open a lock. Examples of keys include a thin piece of metal with a pattern cut in one or more edge, such as an padlock key; a combination, such as that for opening a single dial or multiple rotor combination lock; a sequence for depressing a series of buttons or levers for opening an electronic lock; etc.

The lock can be opened and closed by a key or by any other known means of opening locks, and the locking mechanism can be located at any point along the lock, can be indented or protruded, and can be of any desired shape. Further, the lock can be fastened in a variety of ways at any desired point along the garment, such that when the lock is open the garment opens or falls away from the body. The lock can be made of any suitable or desirable material.

In one embodiment of the present invention, the lock holds a garment together at a single point of closure. Thus, when the lock is unlocked, the garment opens or falls away from the body without any further manipulation such as having to undo buttons or zippers. The locking device also frees the wearer from the problem of having to replace lost buttons or fix broken zippers. The fact that the entire garment is held together at only a single point adds excitement, adventure and romance to the act of wearing clothes.

In another embodiment of the present invention, the locking device holds a garment at a single main point of closure. For example, a bodysuit according to the present invention may have snaps on the bottom to facilitate the ease of wearing the suit. However, unless the locking device is fastened and closed, the bodysuit will not stay on and in place on the body. Similarly, where a garment is stretchable, it may be possible to take off a garment of the present invention without unlocking the locking device. However, this manner of disrobing is highly inconvenient, whereas unlocking the locking device immediately results in the garment opening or falling away from the body, and will add adventure and romance to the process.

In accordance with another embodiment of the invention, a piece of clothing has at least one closure that is secured using a lock. The piece of clothing with one or more points of closure secured by locks is worn by a first person. A second person is provided with a key to at least one of the locks. In one embodiment, a key is provided by the first person (the "wearer") to the second person (the "undresser"). The second person uses the key to open the lock and thereby the closure, helping the undresser towards removing the piece of clothing from the wearer.

Embodiments of the present invention are further described hereinbelow.

BRIEF DESCRIPTION OF THE DRAWINGS

The invention is illustrated in the figures of the accompanying drawings which are meant to be exemplary and not limiting, in which like references are intended to refer to like or corresponding parts, and in which:

FIG. 8 is a close-up view of a rectangular lock threaded through two loops of a neck strap on a lingerie.

FIG. 9 is a sectional view of a rectangular lock threaded through two loops of a neck strap.

DETAILED DESCRIPTION OF THE PREFERRED EMBODIMENTS

Figure 1:
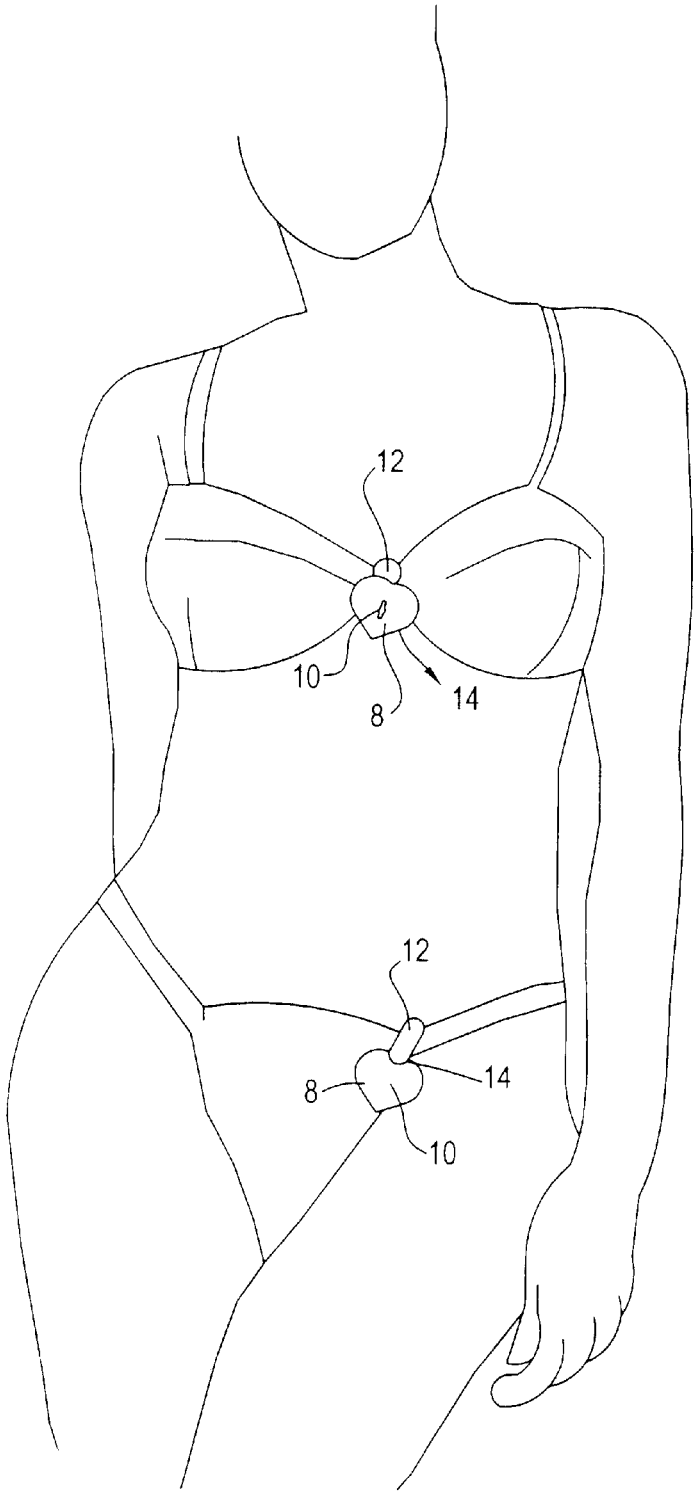
FIG. 1 is a full frontal view of a heart-shaped lock threaded through two D-rings on a lingerie ensemble.
Figure 2:
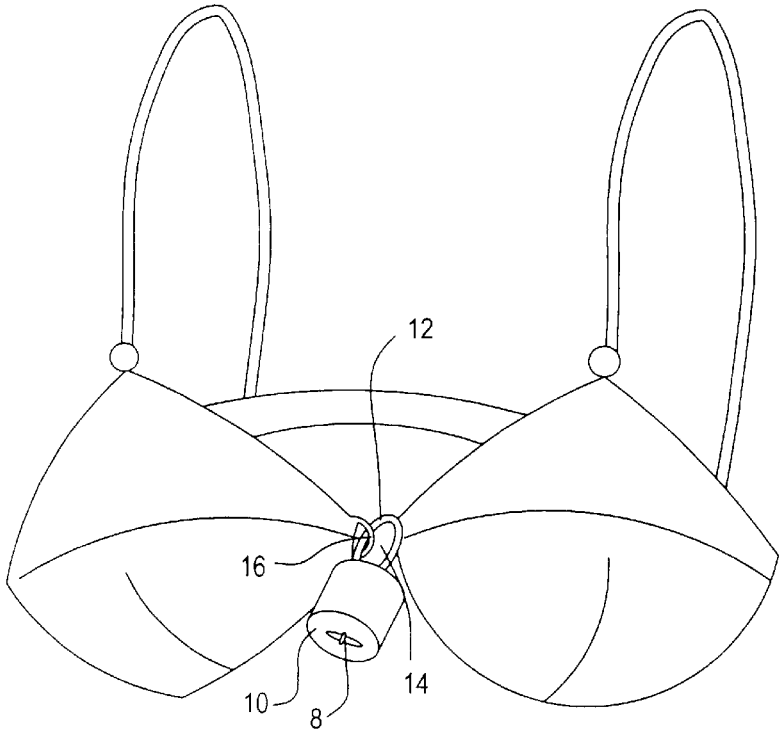
FIG. 2 is a close-up view of a cylindrical lock threaded through two D-rings on a bra.
Figure 3:
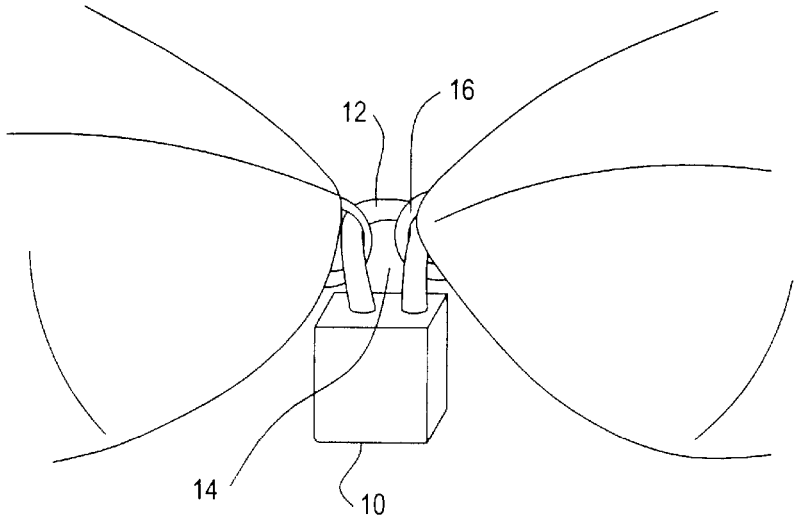
FIG. 3 is a close-up view of a rectangular lock threaded through two D-rings on a bra.

As shown in the Figures, the upper portion of the lock 10 has a handle 12, preferably curving, which is used to fasten the lock to the point of closure 14. Referring to FIGS. 1–3, the lock handle 12 is thread through two D-rings 16 which are attached to opposite sides of the point of closure 14. This fastening arrangement is especially advantageous when the garment is a bra, but can be used with other garments as well. Referring to FIG. 1, the lock 10 is heart shaped, with the locking mechanism 8 located in the middle of the lock 10. Each piece of the two-piece lingerie set in FIG. 1 has a single point of closure, but it may be possible, although not comfortable, to take off the bottom piece without opening the lock if the bottom piece is made of stretchable material. In either event, unlocking the lock causes the garment to fall away from the body and the garment is held on and in place on the body only if the lock is fastened and locked. FIGS. 2 and 3 are close-ups of the fastening arrangement of the top lingerie piece of FIG. 1. Referring to FIG. 2, the lock is cylindrical in shape and the locking mechanism 8 appears at the bottom of the lock 10. Referring to FIG. 3, the lock 10 is rectangular in shape and the garment has a single point of closure.

Figure 4:
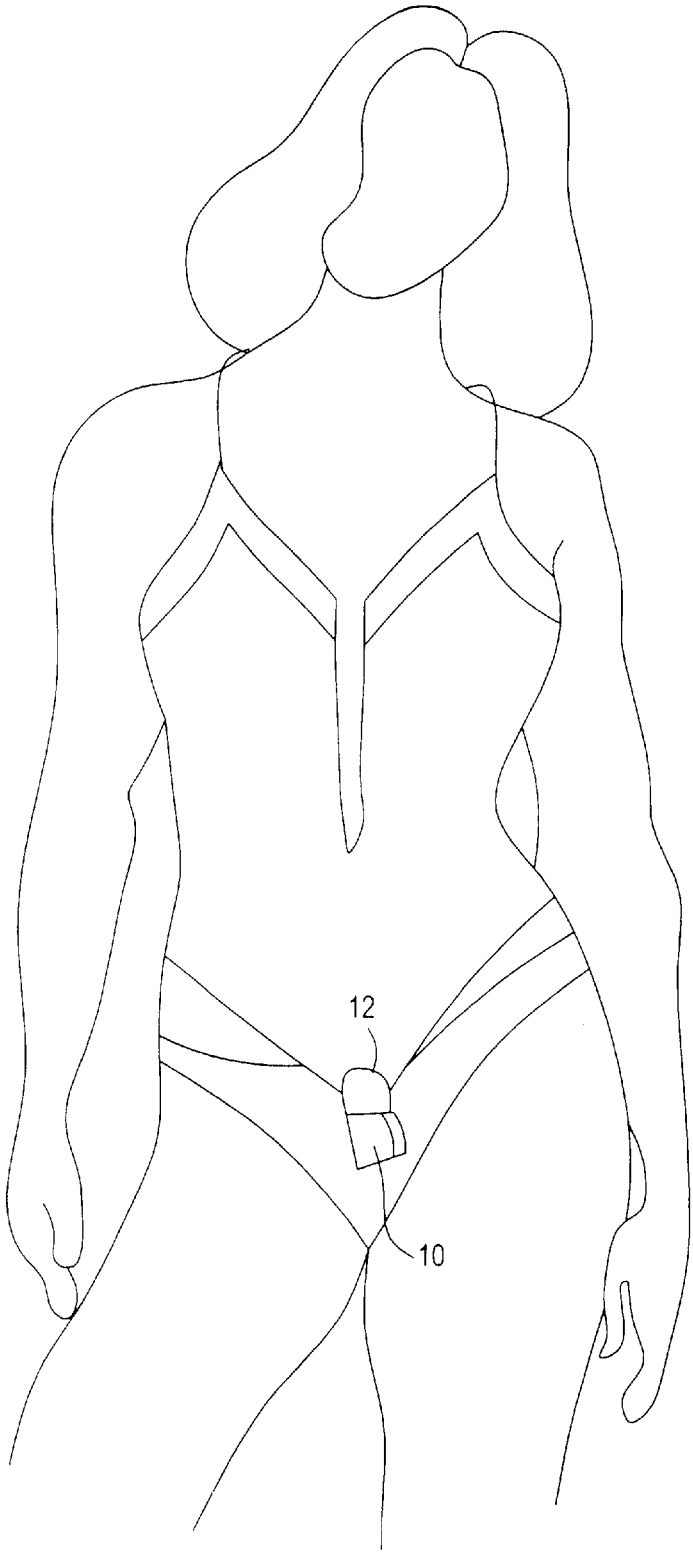
FIG. 4 is a full frontal view of a square lock threaded through a loop which is threaded through a button hole on a lingerie or bathing suit.
Figure 5:
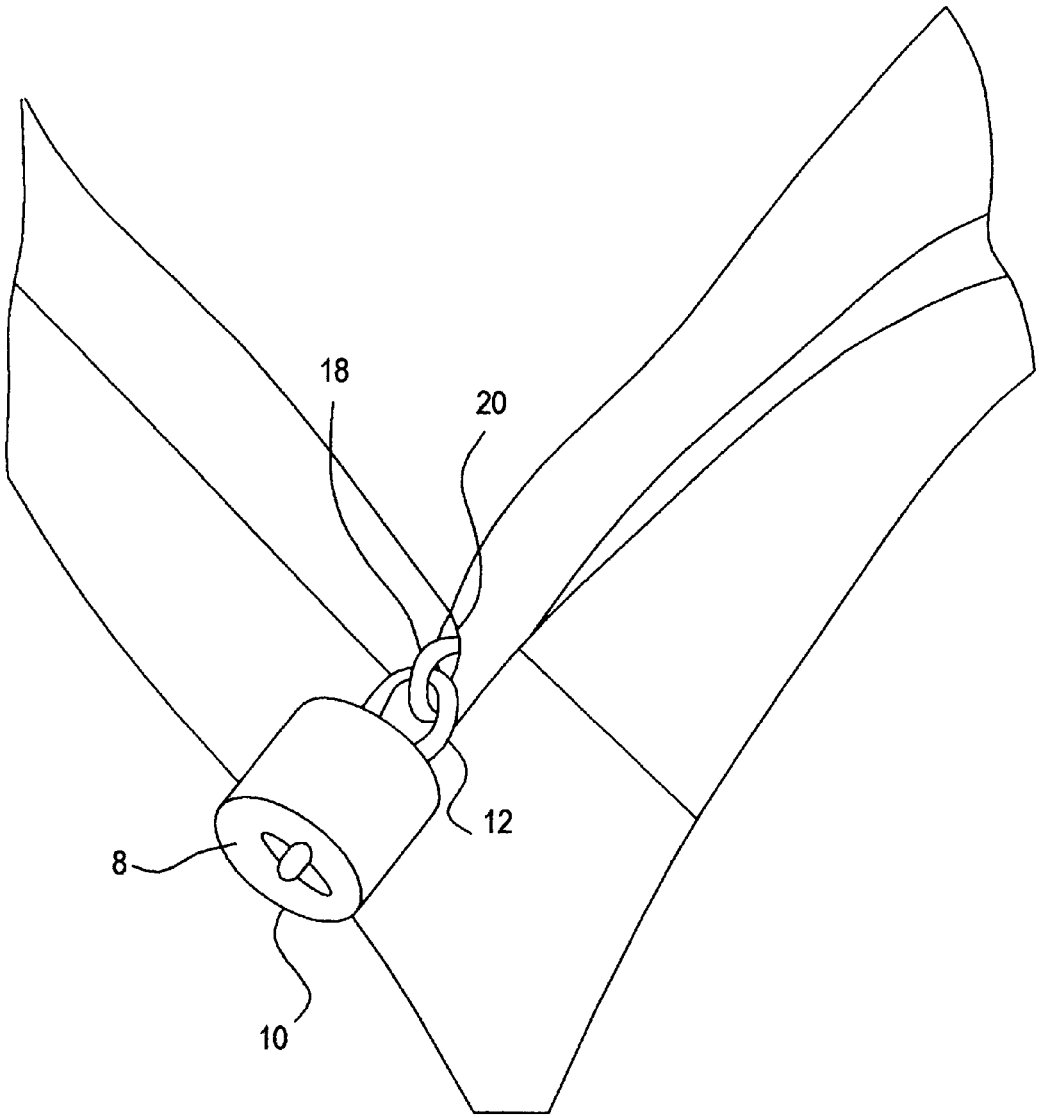
FIG. 5 is a close-up view of a cylindrical lock threaded through a loop which is threaded through a button hole.
Figure 6A:
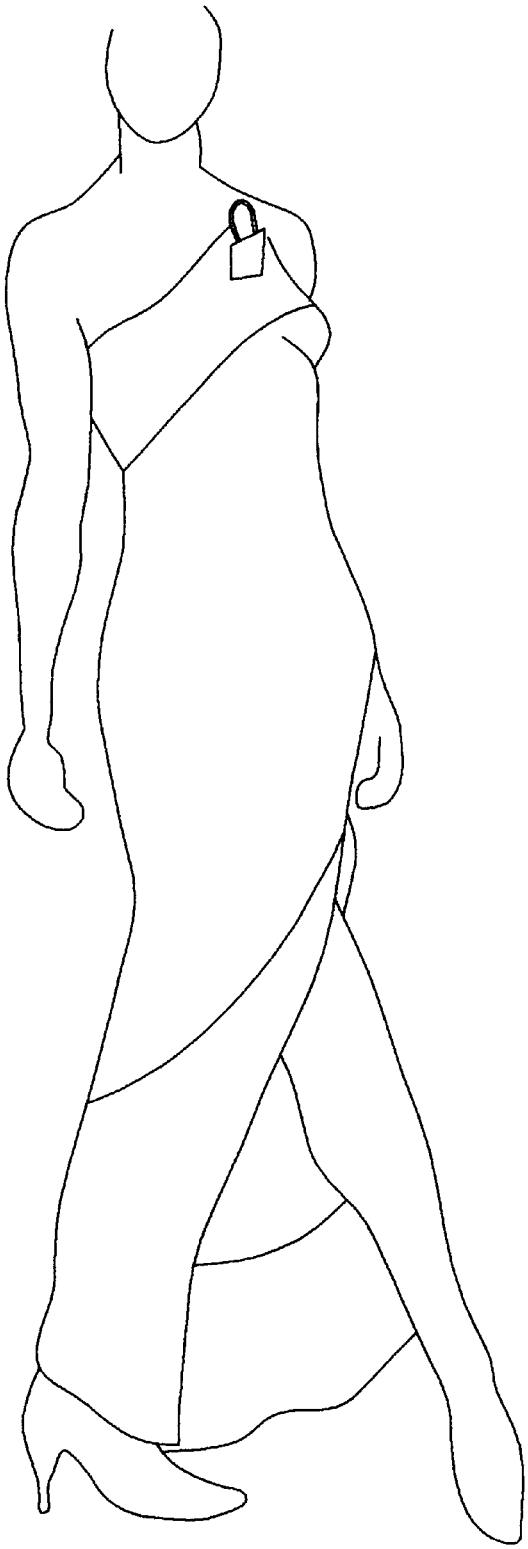
FIG. 6A is a full frontal view of a dress having a rectangular lock threaded through a loop which is threaded through a button hole on the shoulder of the dress.
Figure 6B:
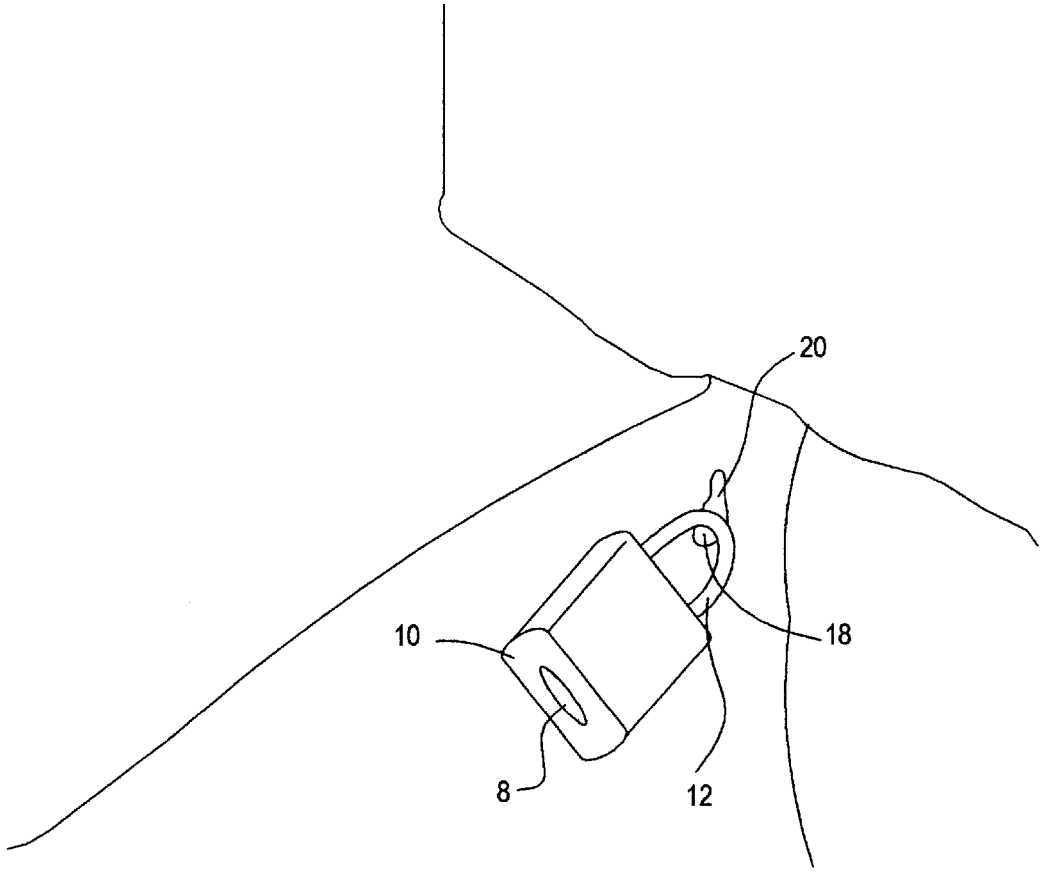
FIG. 6B is a close-up view of the shoulder of the dress in FIG. 6A.

Referring to FIGS. 4, 5, 6A and 6B, the lock handle 12 is thread through a loop 18 which itself is thread through a button hole 20. The loop can be made of any desired material and can, for example, be a chain ring. FIG. 4 shows a garment with this fastening arrangement. The garment shown has a single point of closure but can also be made with snaps on the bottom. In either event, unlocking the lock results in the garment opening or falling away from the body. If the garment is made of stretchable material it may be possible to take it off without unlocking the lock, but such a way of disrobing is uncomfortable, whereas unlocking the lock causes the garment to open immediately. FIG. 5 shows use of this fastening arrangement to close the garment at a point where one piece of material overlaps another. FIGS. 6A and 6B show use of this fastening arrangement to hold a garment, such as an evening dress, at the shoulder. Unlocking the lock causes the dress to fall away from the body and the garment is held on and in place on the body only if the lock is fastened and locked. It is understood that the uses shown are merely illustrative and that other uses will become apparent to one skilled in the art.

Figure 7:
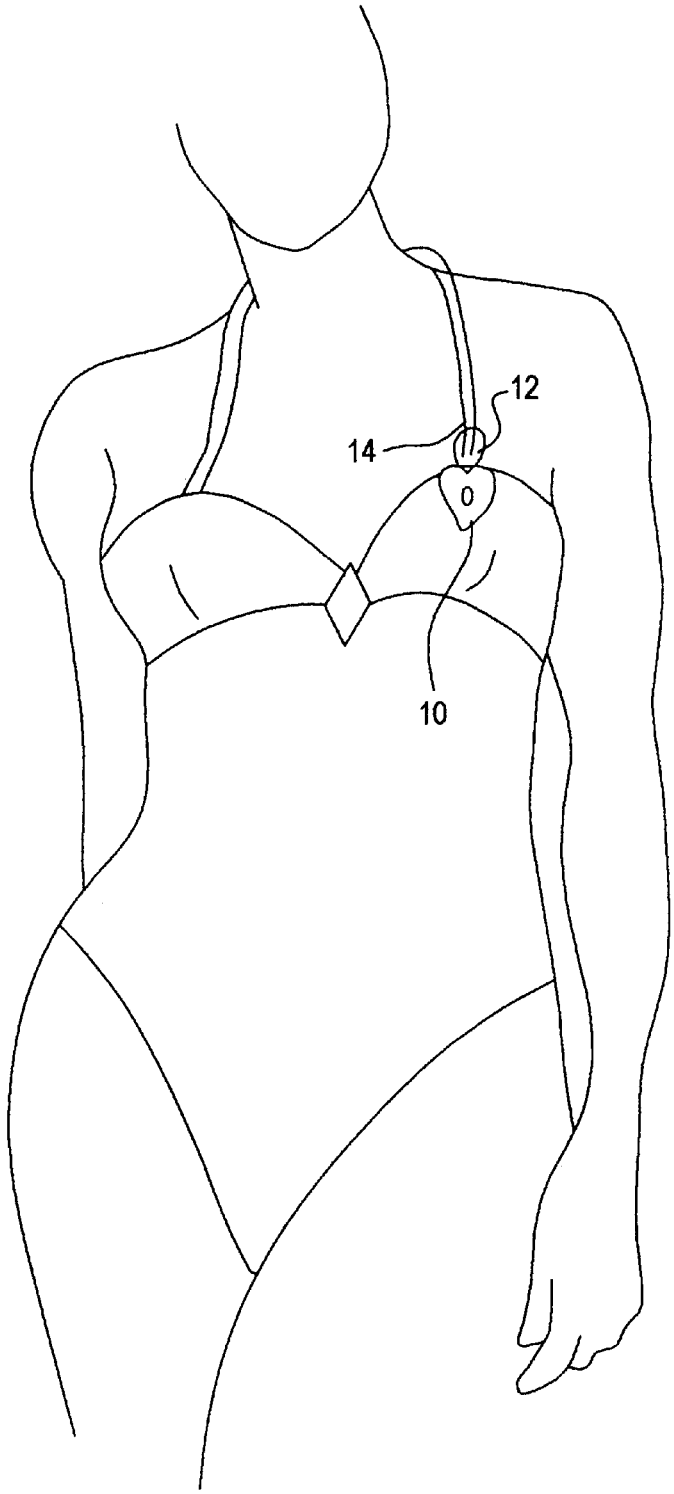
FIG. 7 is a full frontal view of a heart-shaped lock threaded through two loops of a neck strap on a lingerie or a bathing suit.

Referring to FIGS. 7–9, the lock handle 12 is thread through two loops 22, which are attached to the opposite sides of the point of closure 14. This fastening arrangement is especially advantageous with garments having a neck chain strap, where the strap can be made of any suitable material. FIG. 7 shows use of this fastening arrangement to hold the neck strap of a bathing suit to the body of the bathing suit. Unlocking the lock causes the bathing suit to fall away from the body and the garment is held on and in place on the body only if the lock is fastened and locked. FIGS. 7 and 8 show close-ups of the fastening arrangement of FIG. 7.

Figure 10:
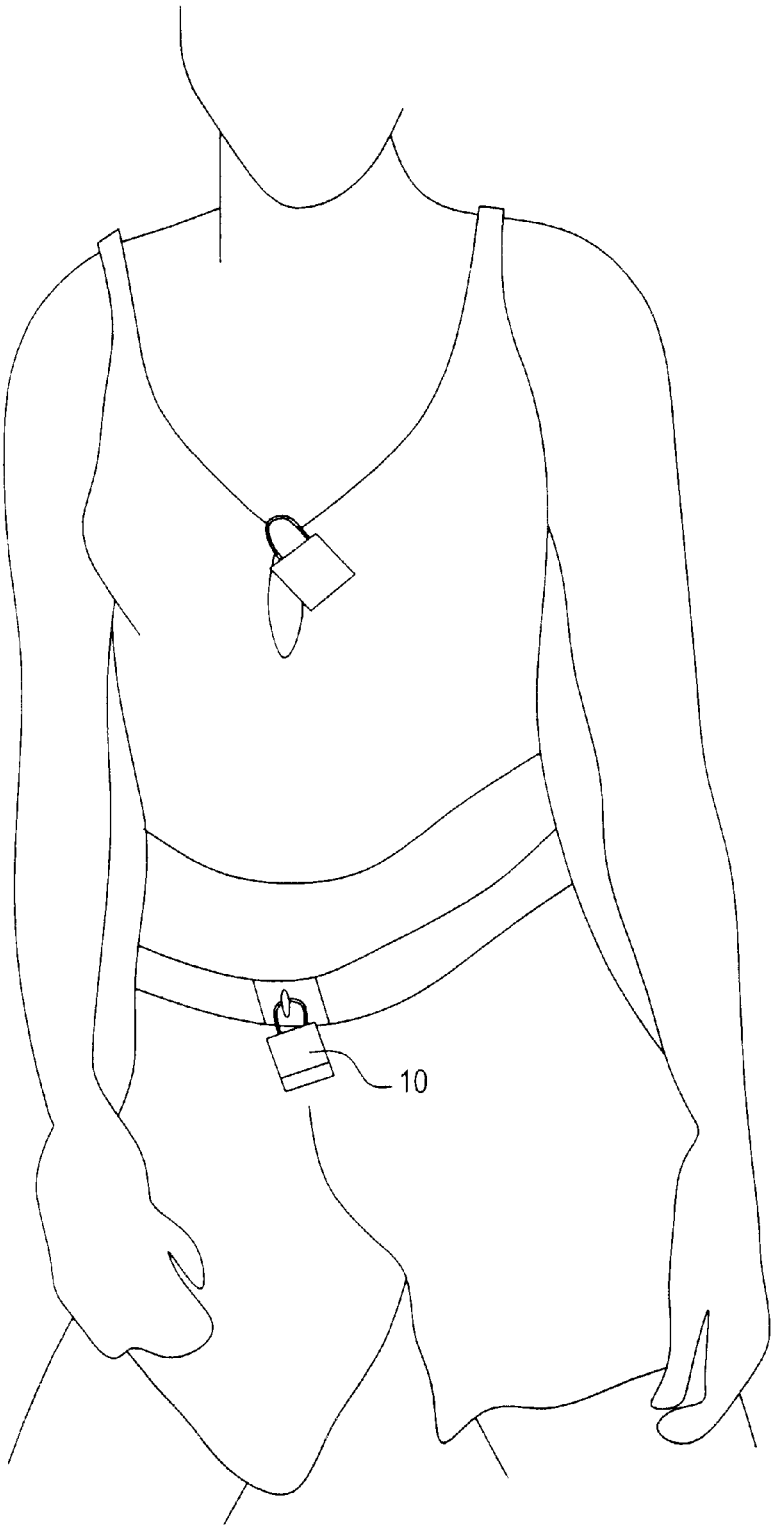
FIG. 10 is a full frontal view of a rectangular lock threaded through a D-ring which is threaded through a button hole on a short waistband and on a top.
Figure 11:
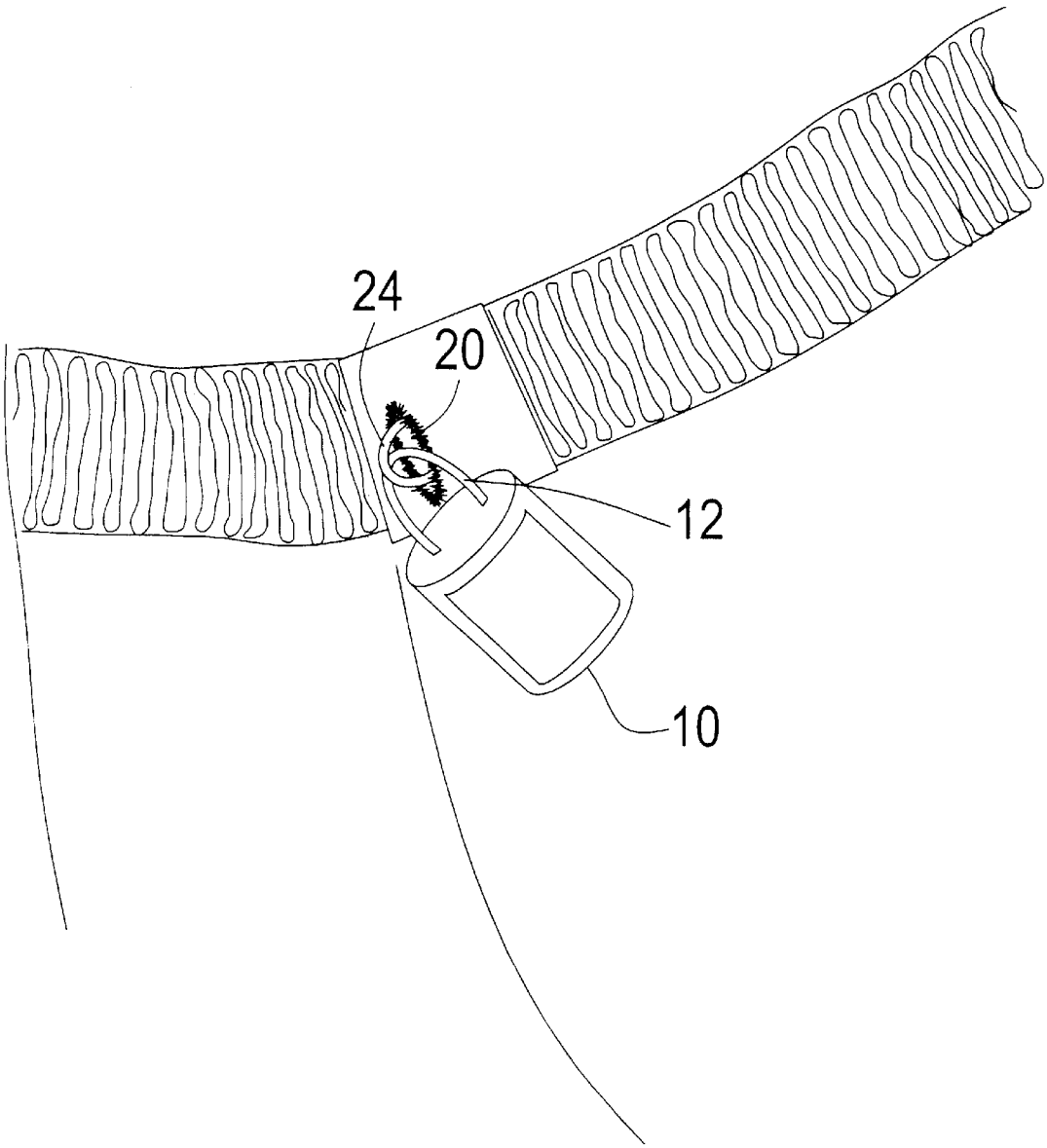
FIG. 11 is a close up view of a rectangular lock threaded through a D-ring which is threaded through a button hole on a pant waistband.
Figure 12:
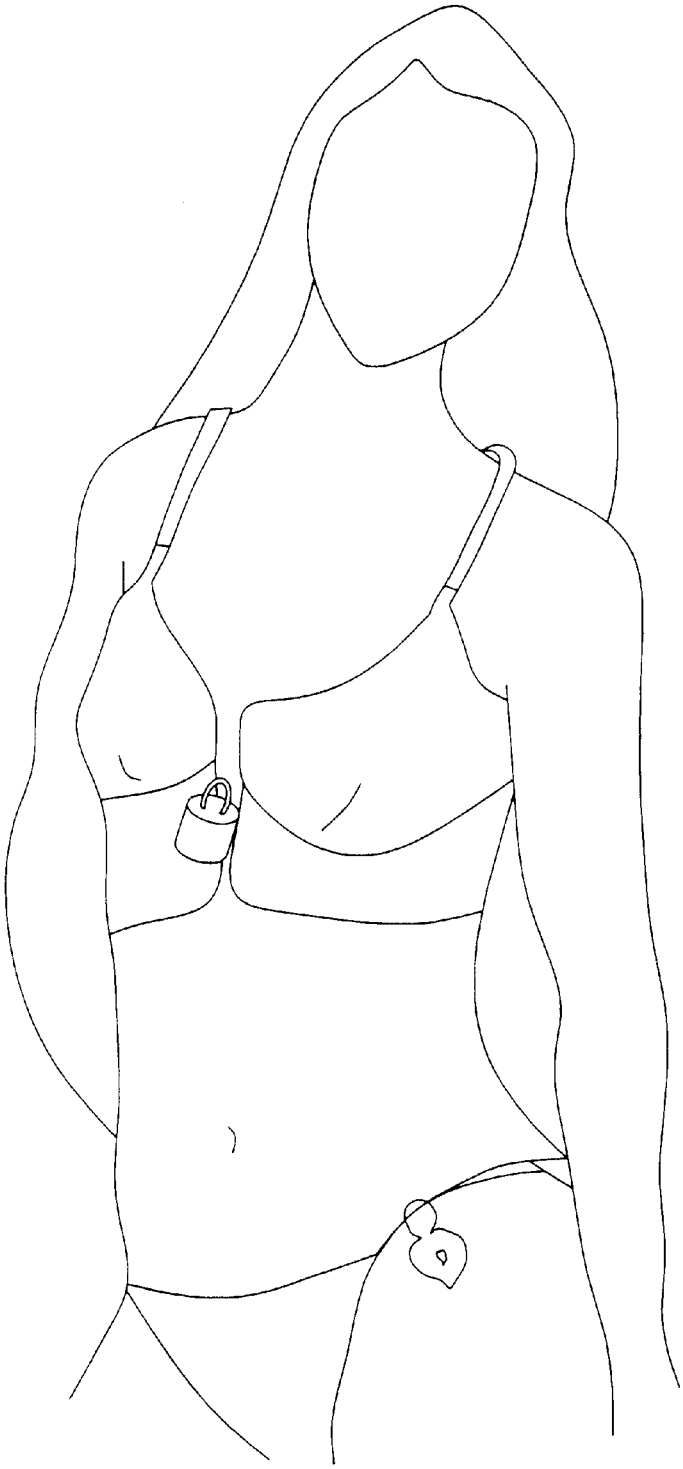
FIG. 12 is an alternative embodiment of the closure of this invention on lingerie.
Figure 13:
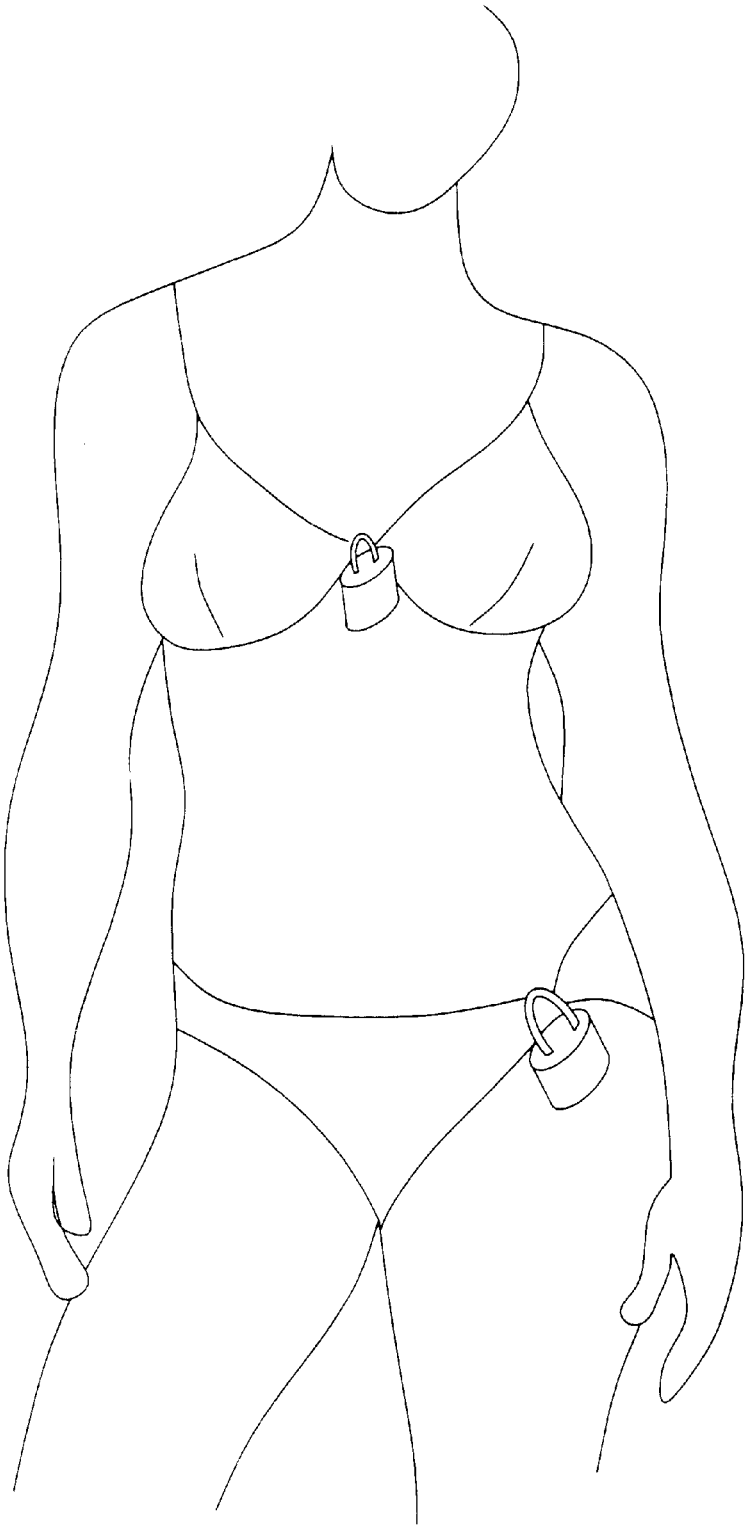
FIG. 13 is an alternative embodiment of the closure of this invention on lingerie or a bathing suit.
Figure 14:
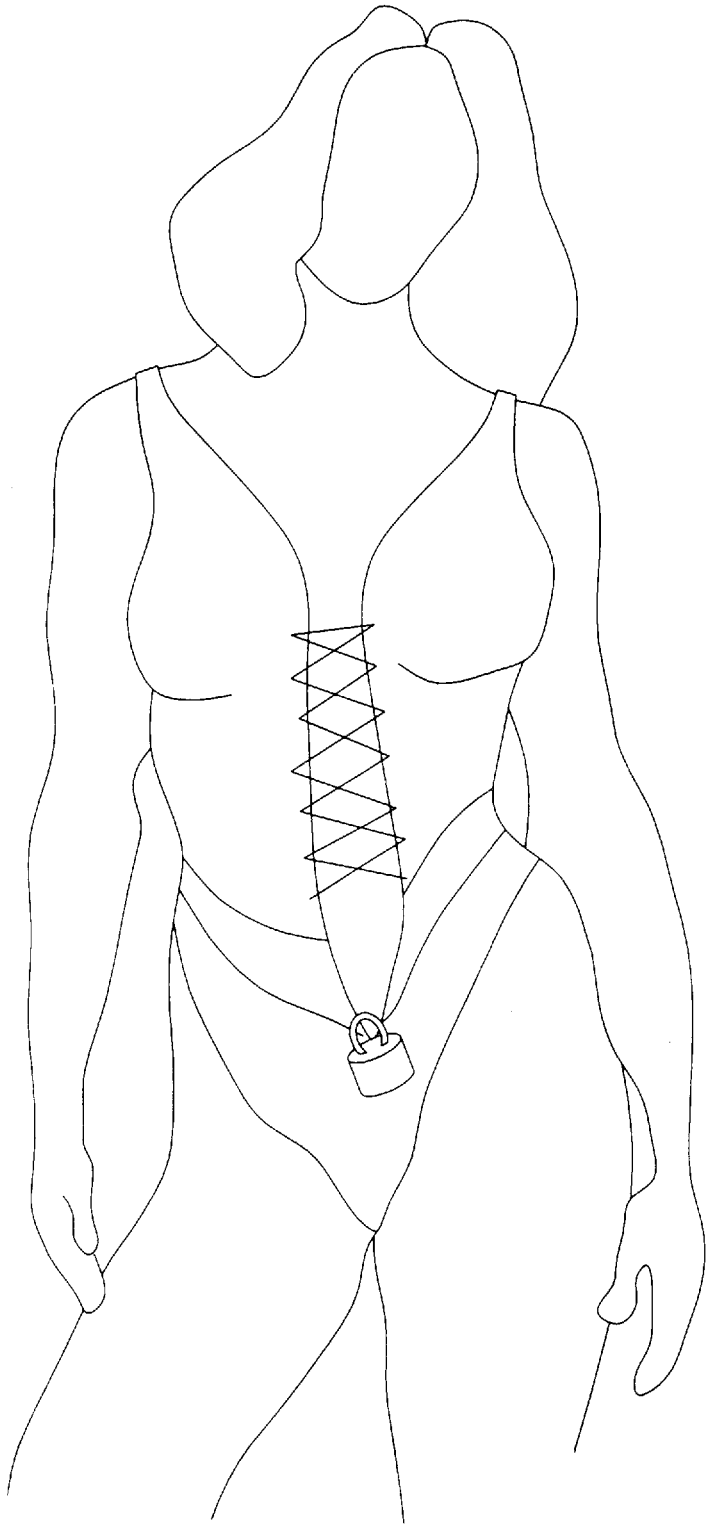
FIG. 14 is an alternative embodiment of the closure of this invention on lingerie or a bathing suit.
Figure 15:
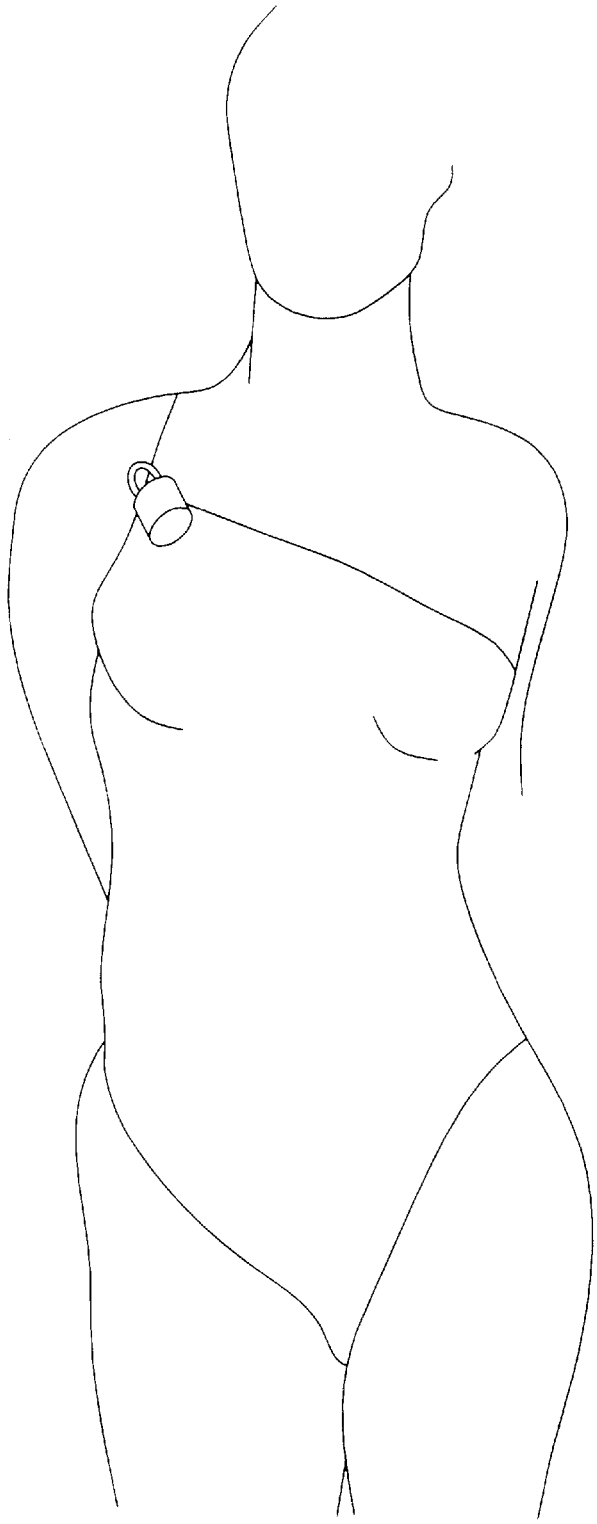
FIG. 15 is an alternative embodiment of the closure of this invention on lingerie or bodysuit or bathing suit.
Figure 16:
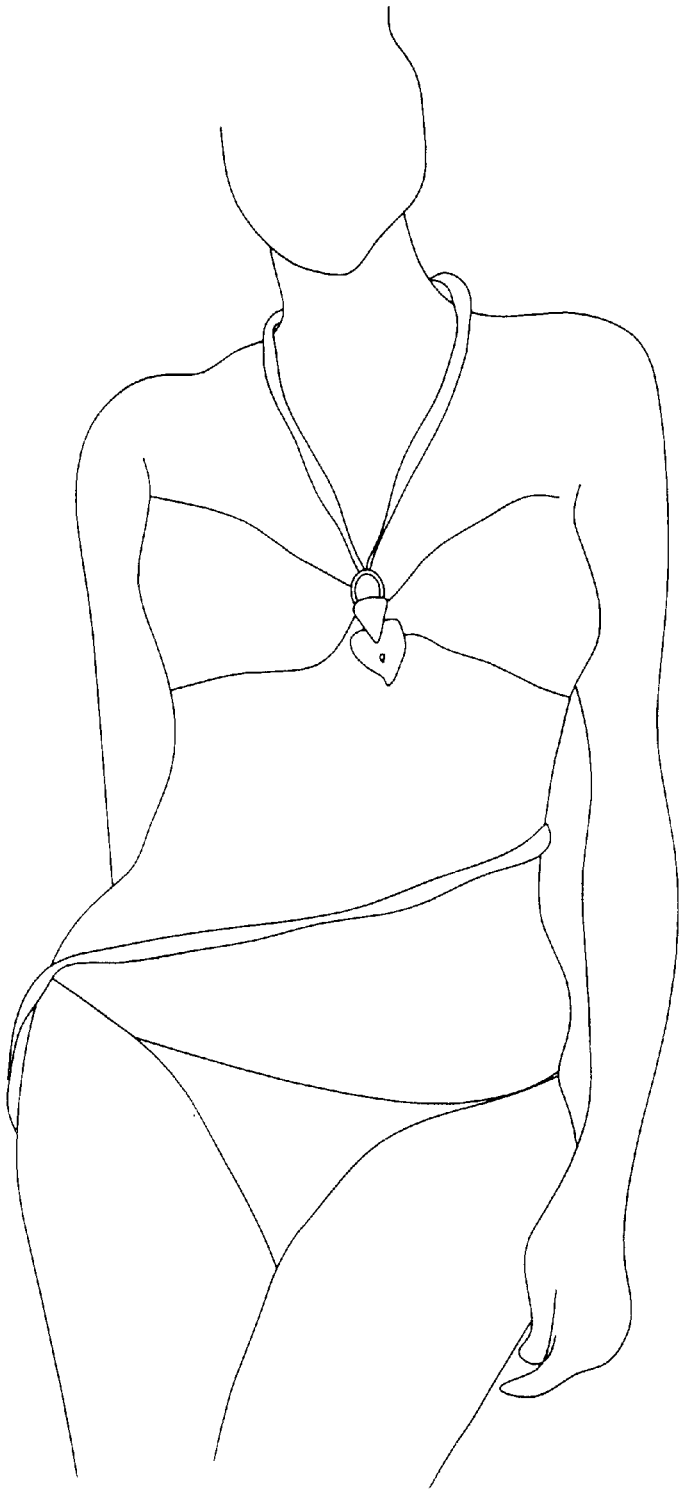
FIG. 16 is an alternative embodiment of the closure of this invention on a bathing suit.
Figure 17:
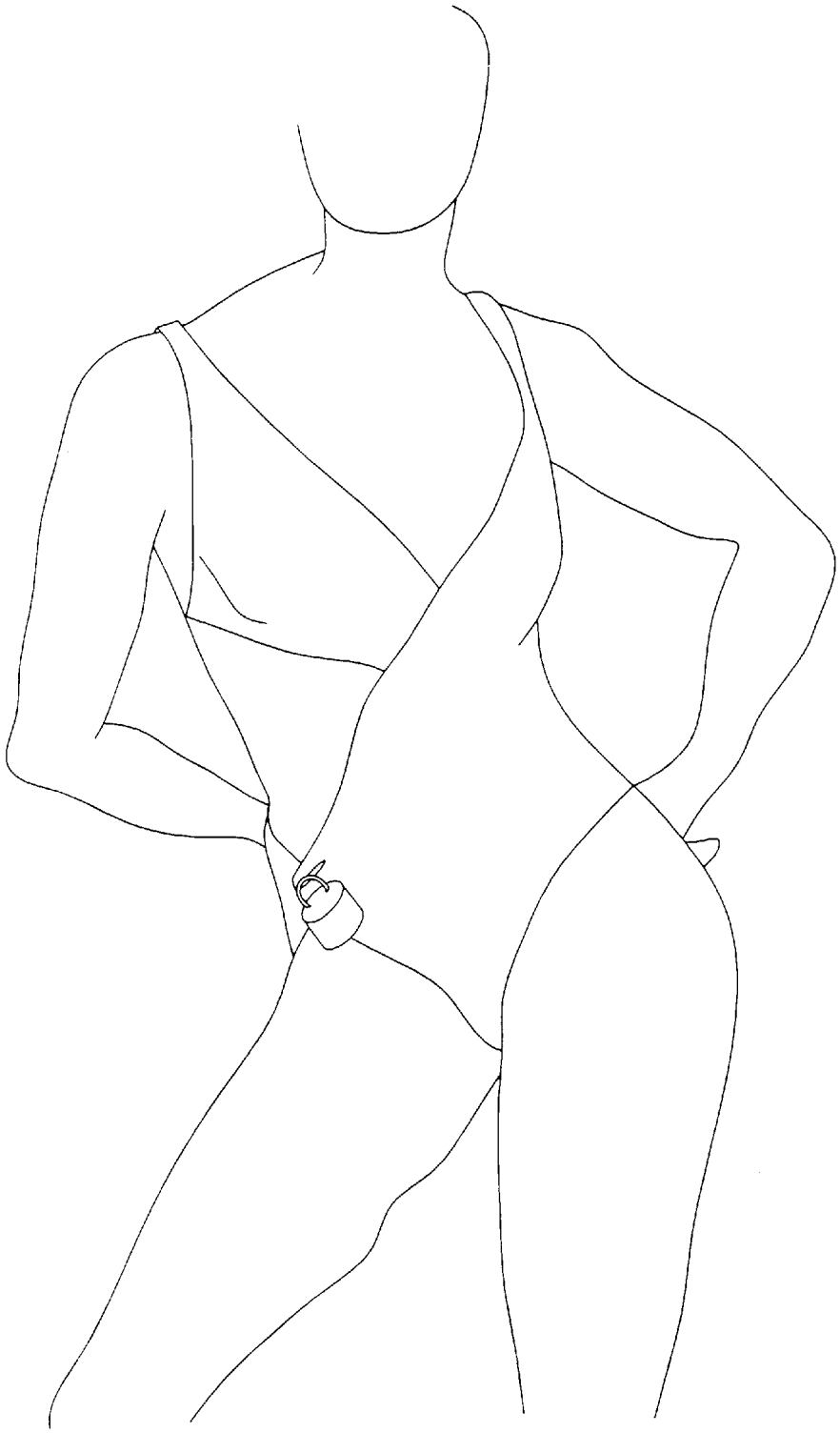
FIG. 17 is an alternative embodiment of the closure of this invention on a bathing suit.
Figure 18:
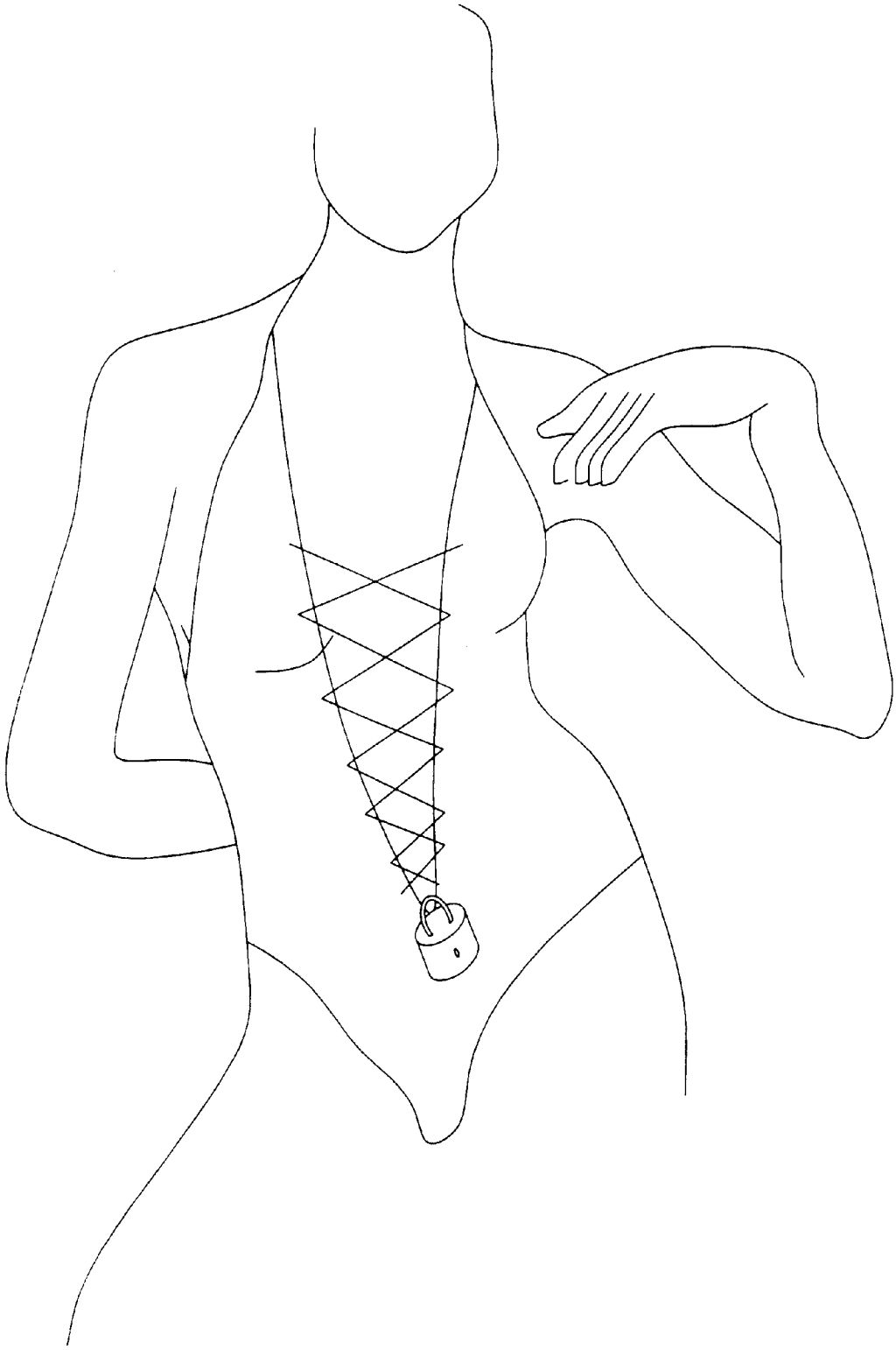
FIG. 18 is an alternative embodiment of the closure of this invention on a bathing suit.
Figure 19:
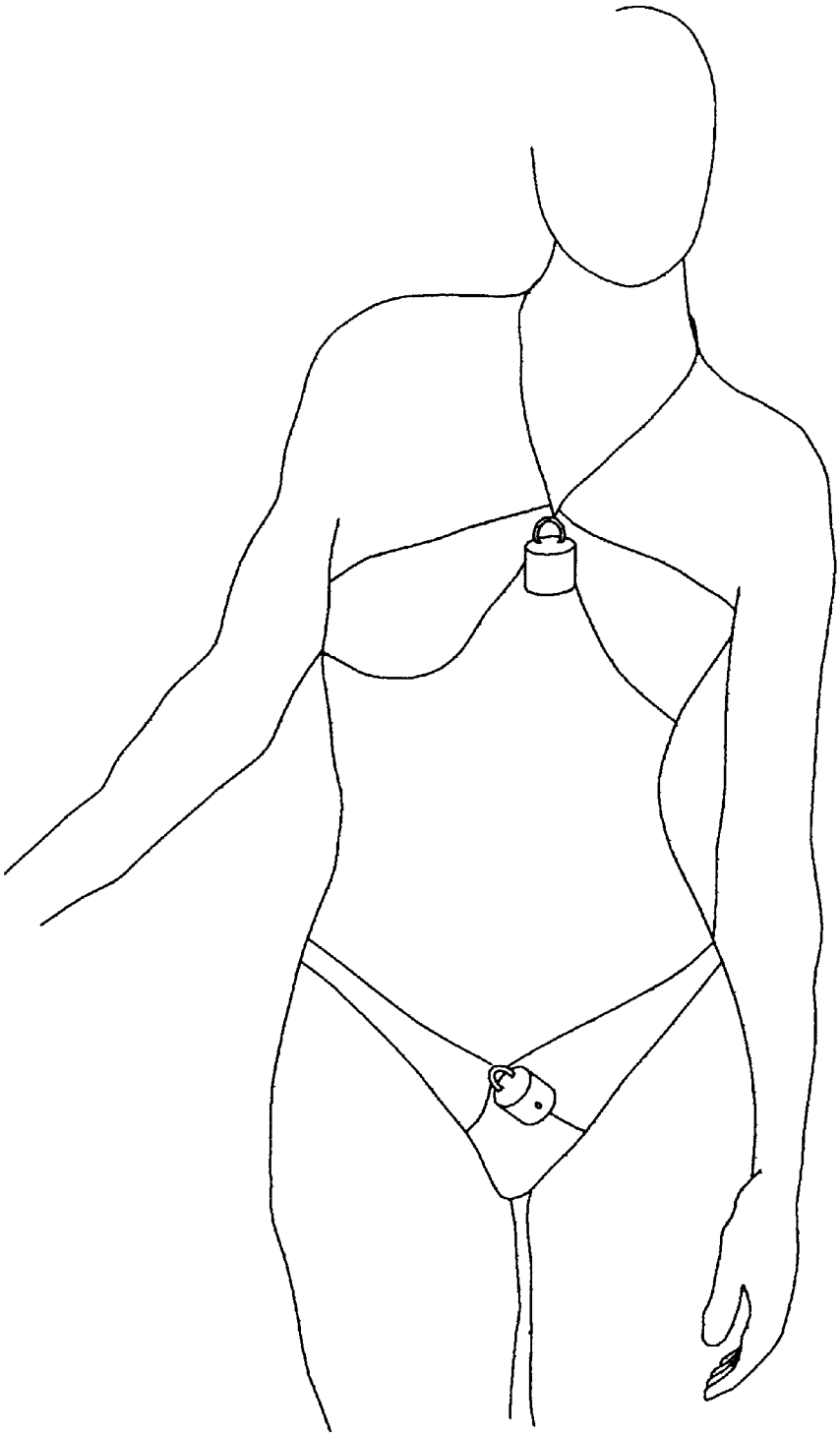
FIG. 19 is an alternative embodiment of the closure of this invention on lingerie or bathing suit.
Figure 20:
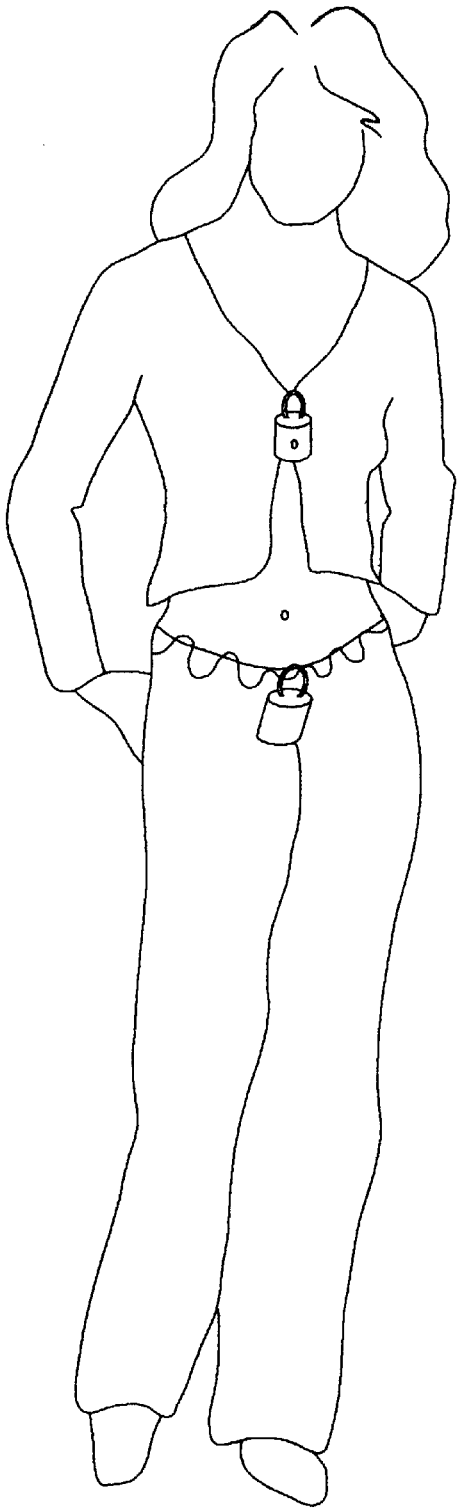
FIG. 20 is an alternative embodiment of the closure of this invention on pants and a top shirt or a jacket.
Figure 21:
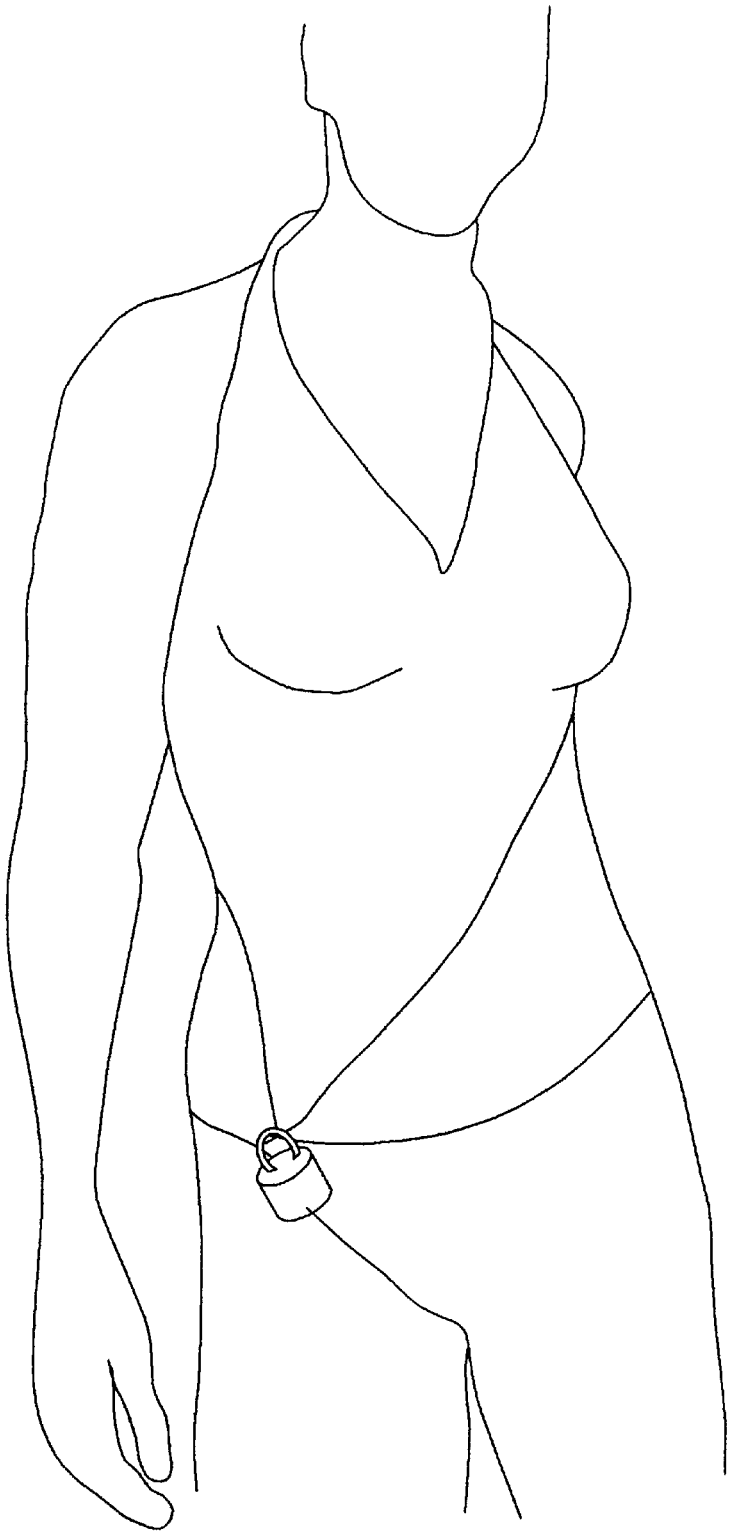
FIG. 21 is an alternative embodiment of the closure of this invention on a pantsuit or bodysuit.
Figure 22:
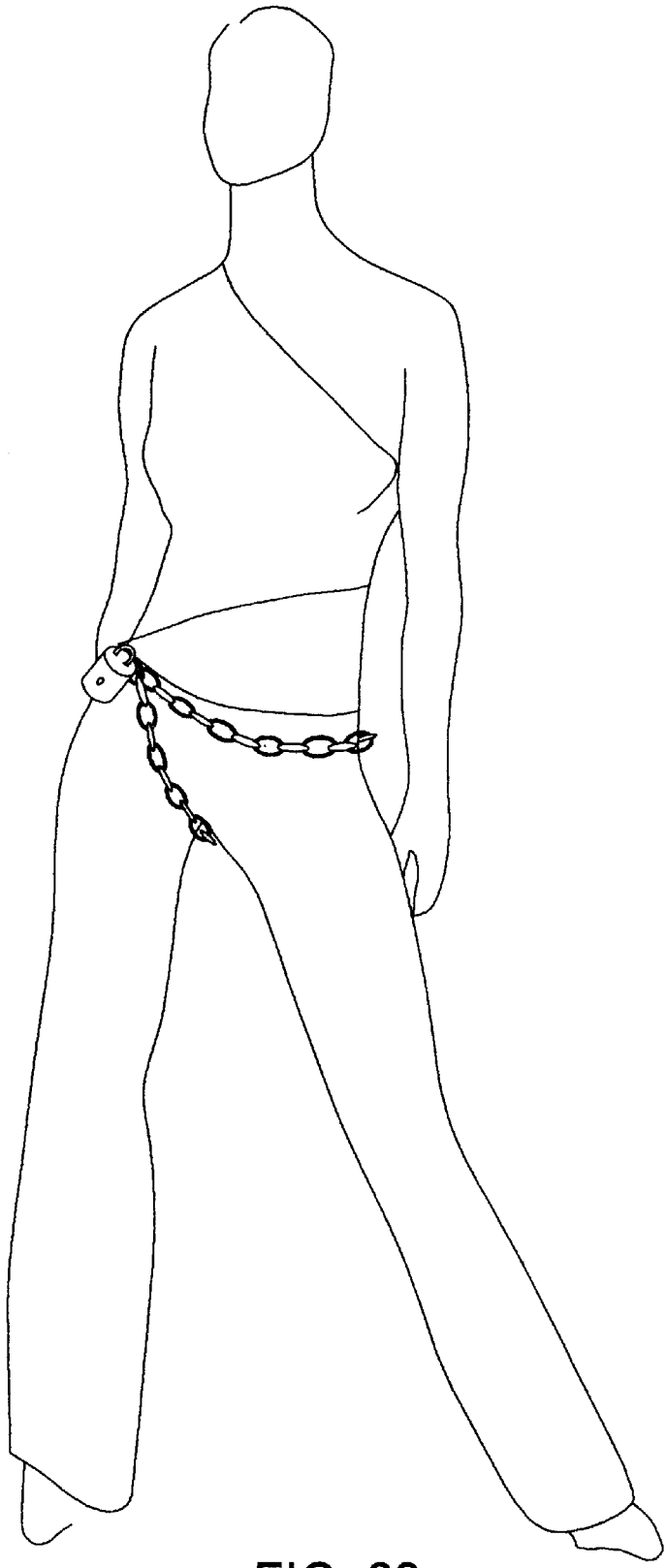
FIG. 22 is an alternative embodiment of the closure of this invention on a pantsuit or bodysuit.
Figure 23:
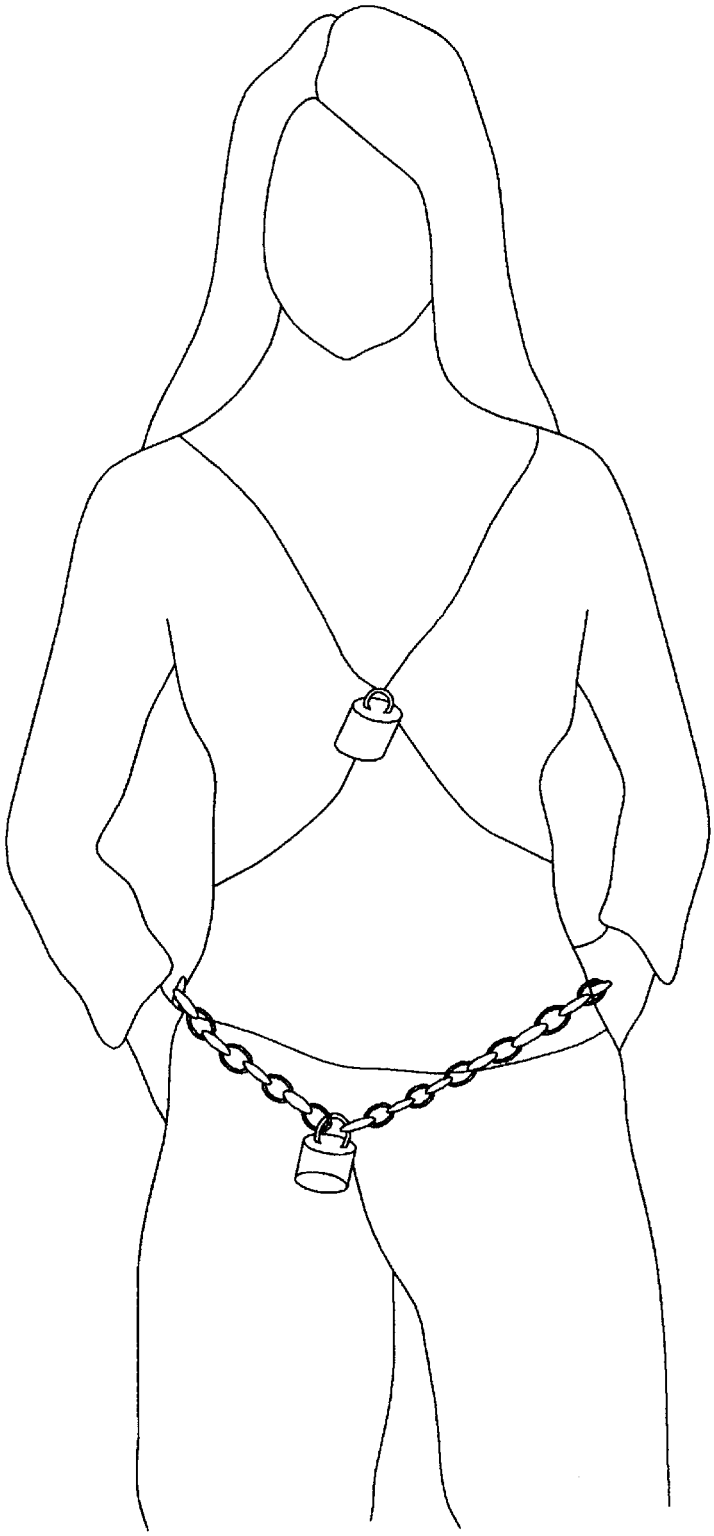
FIG. 23 is an alternative embodiment of the closure of this invention on pants and a top.
Figure 24:
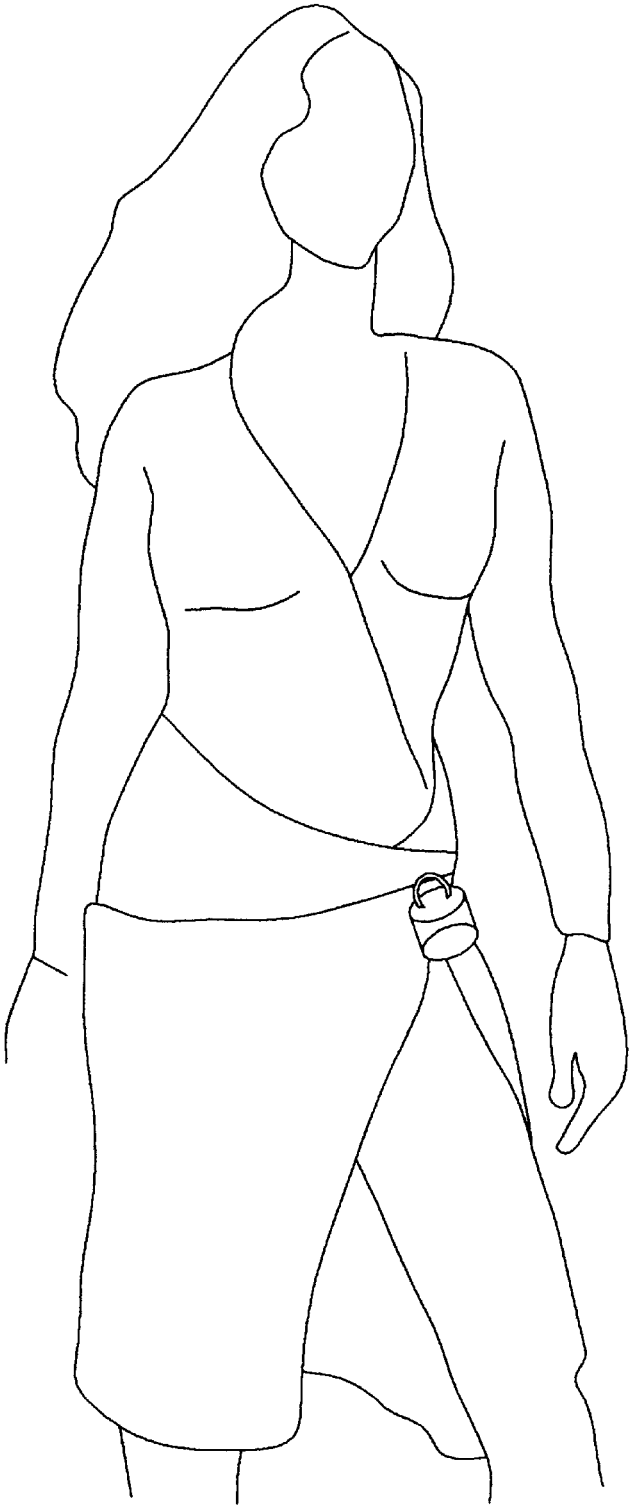
FIG. 24 is an alternative embodiment of closure of this invention on a skirt.
Figure 25:
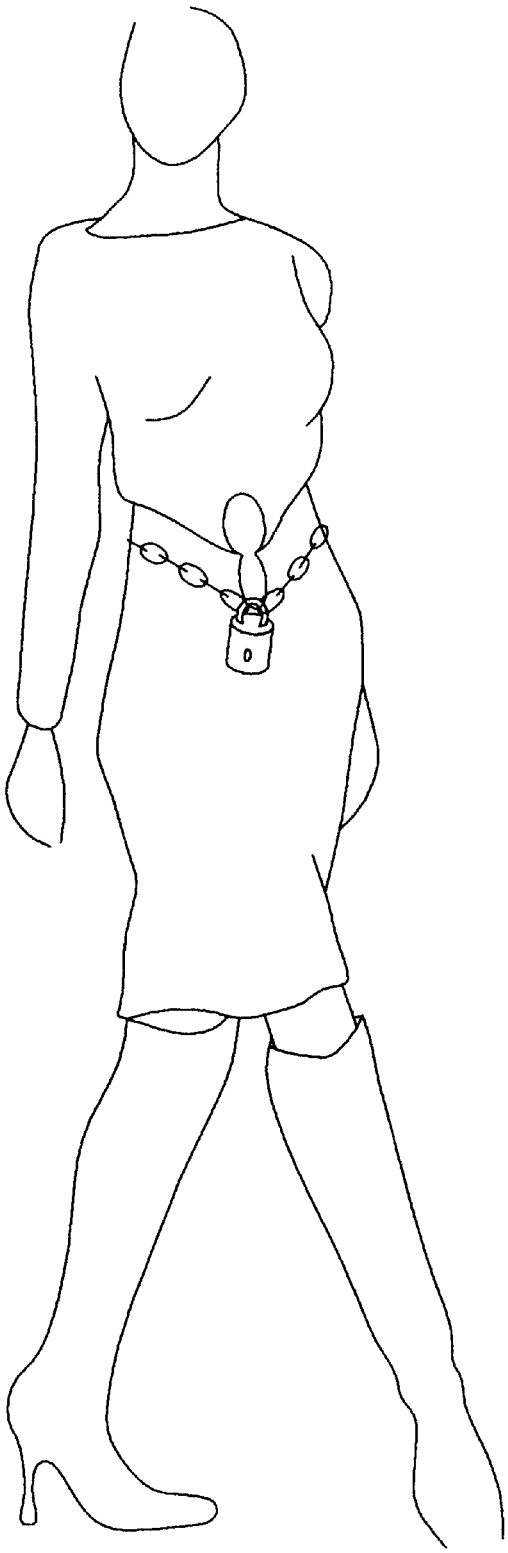
FIG. 25 is an alternative embodiment of the closure of this invention on a dress.
Figure 26:
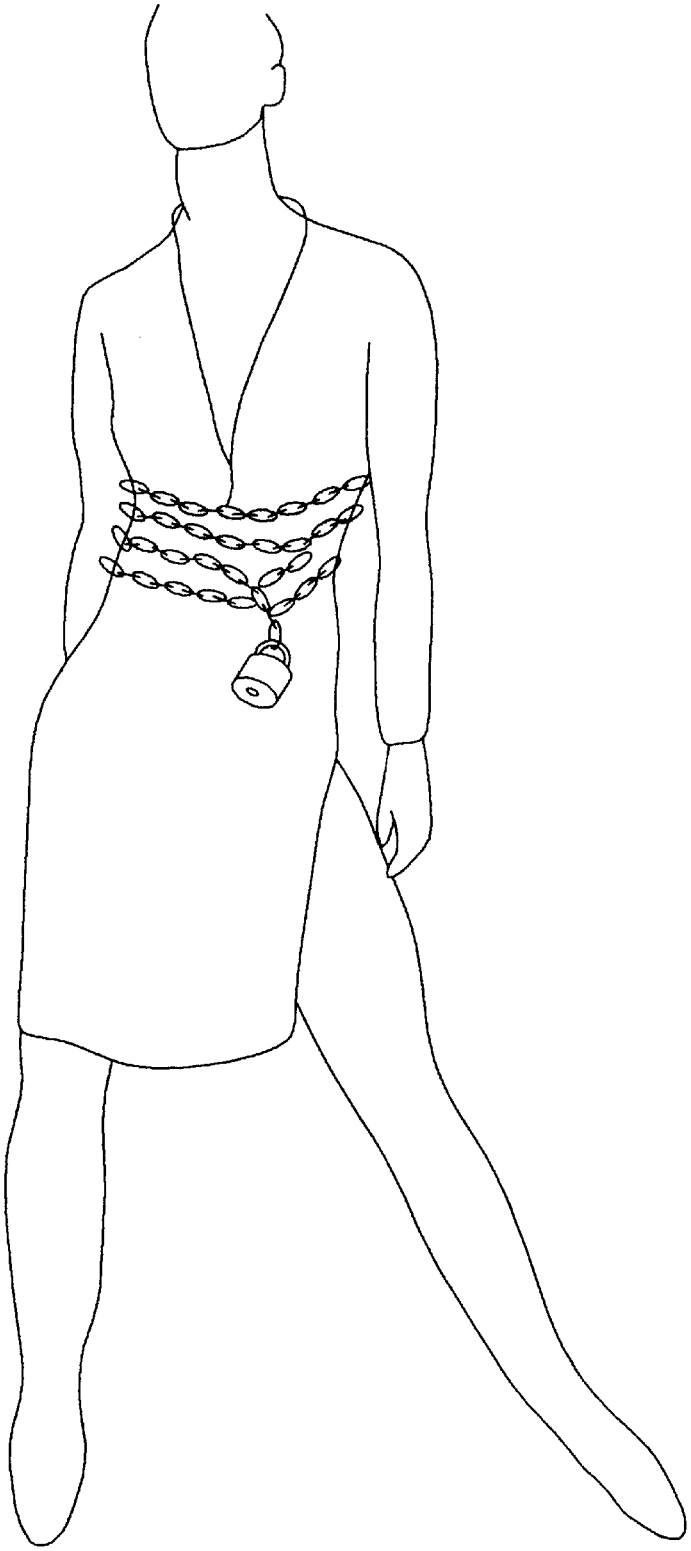
FIG. 26 is an alternative embodiment of the closure of this invention on a belt which holds closed an exaggeratedly low V-neck of a dress.
Figure 27:
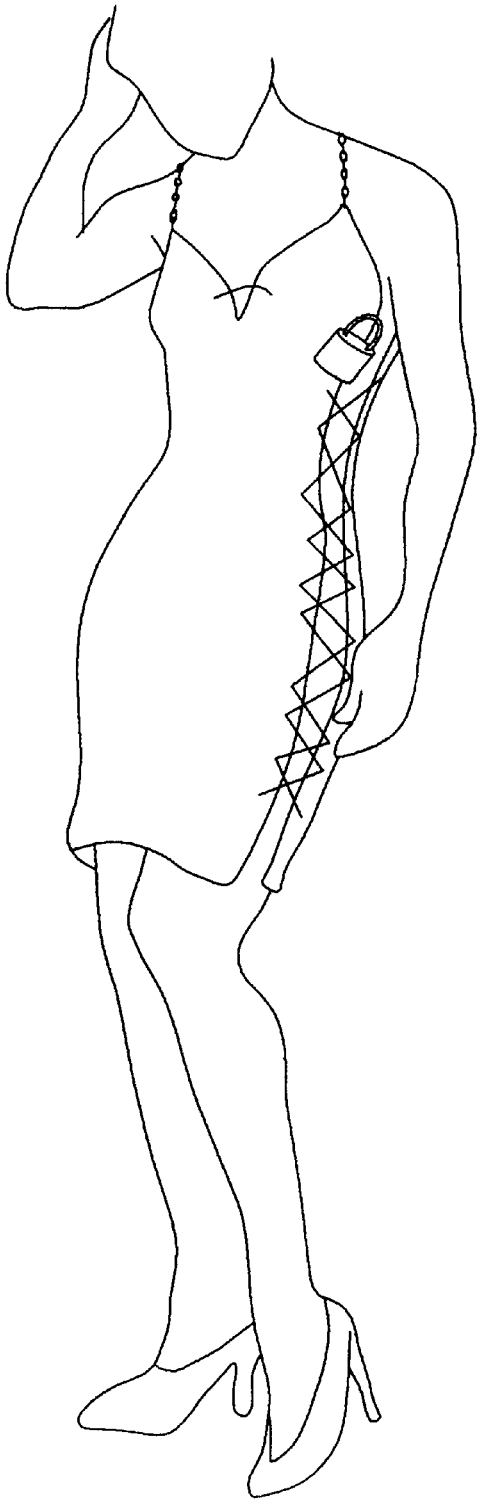
FIGS. 27–33 are alternative embodiments of the closure of this invention on a dress.
Figure 28:
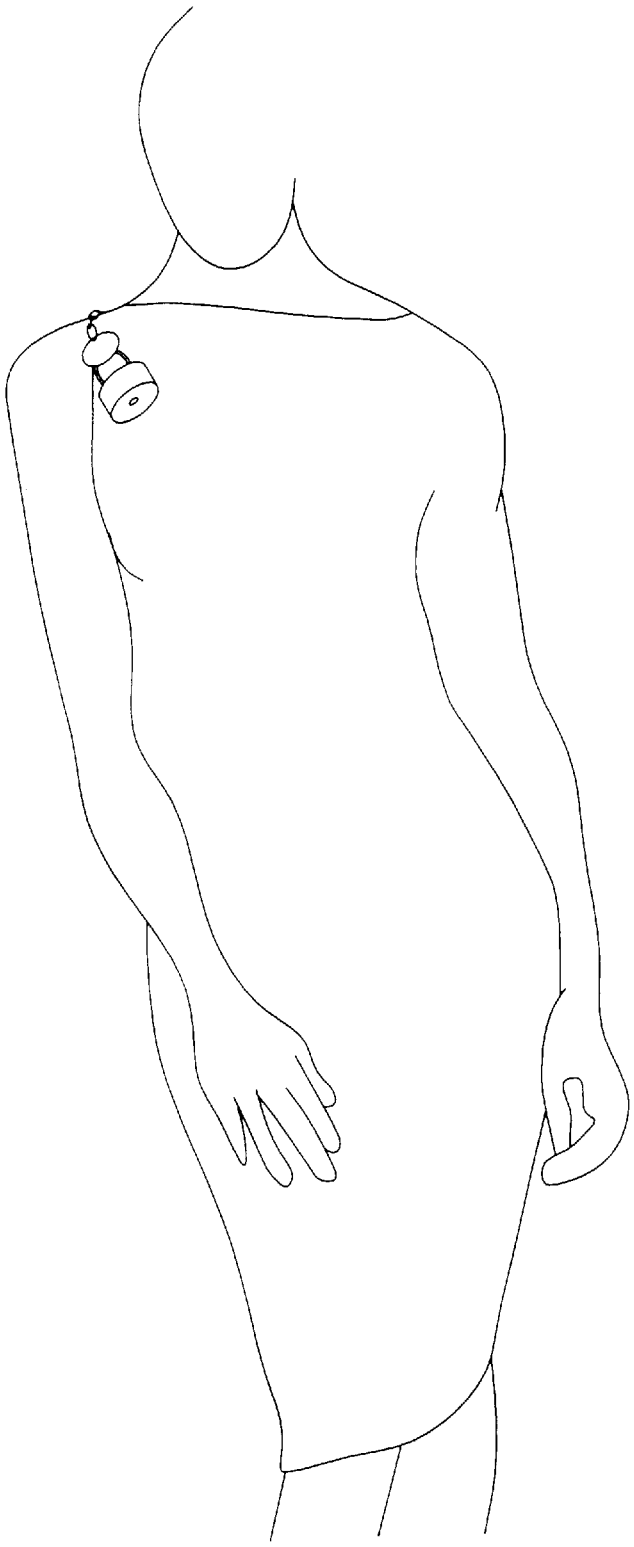
Figure 29:
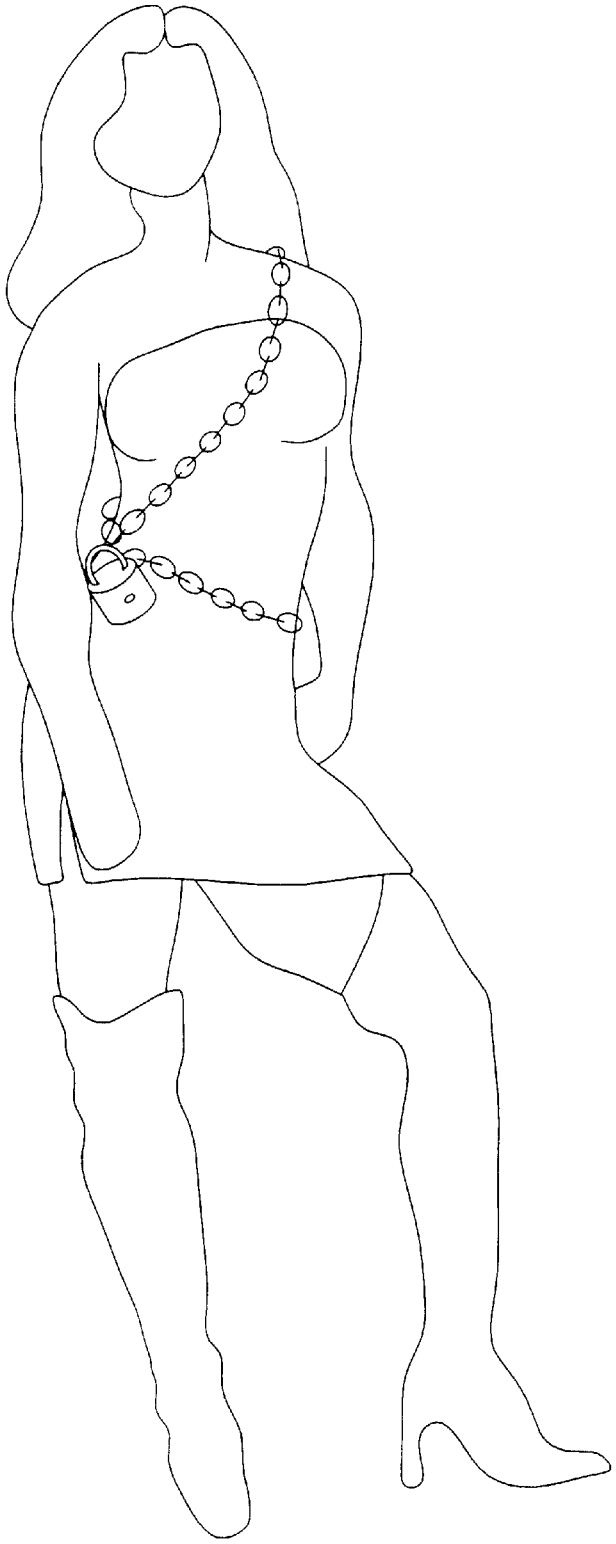
Figure 30:
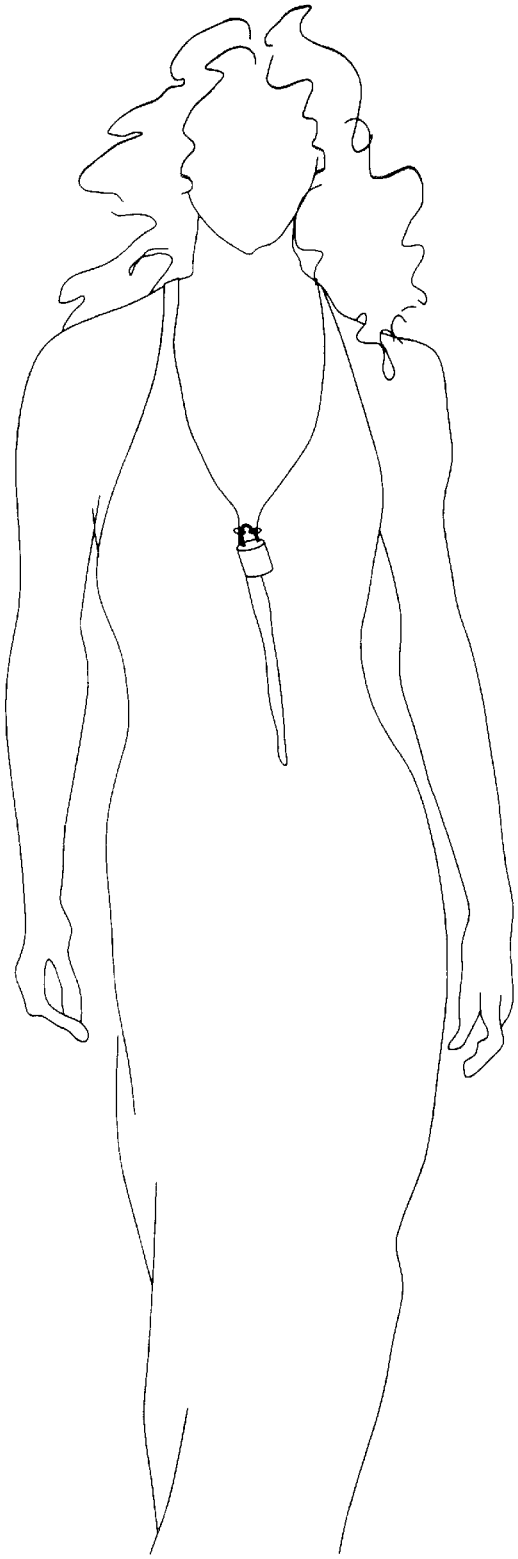
Figure 31:
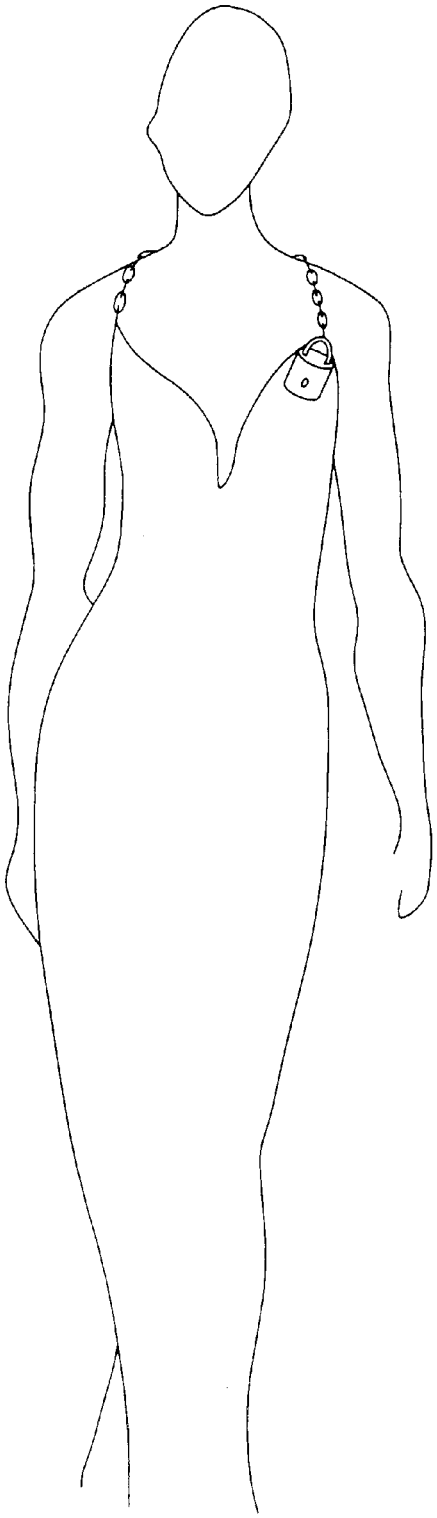
Figure 32:
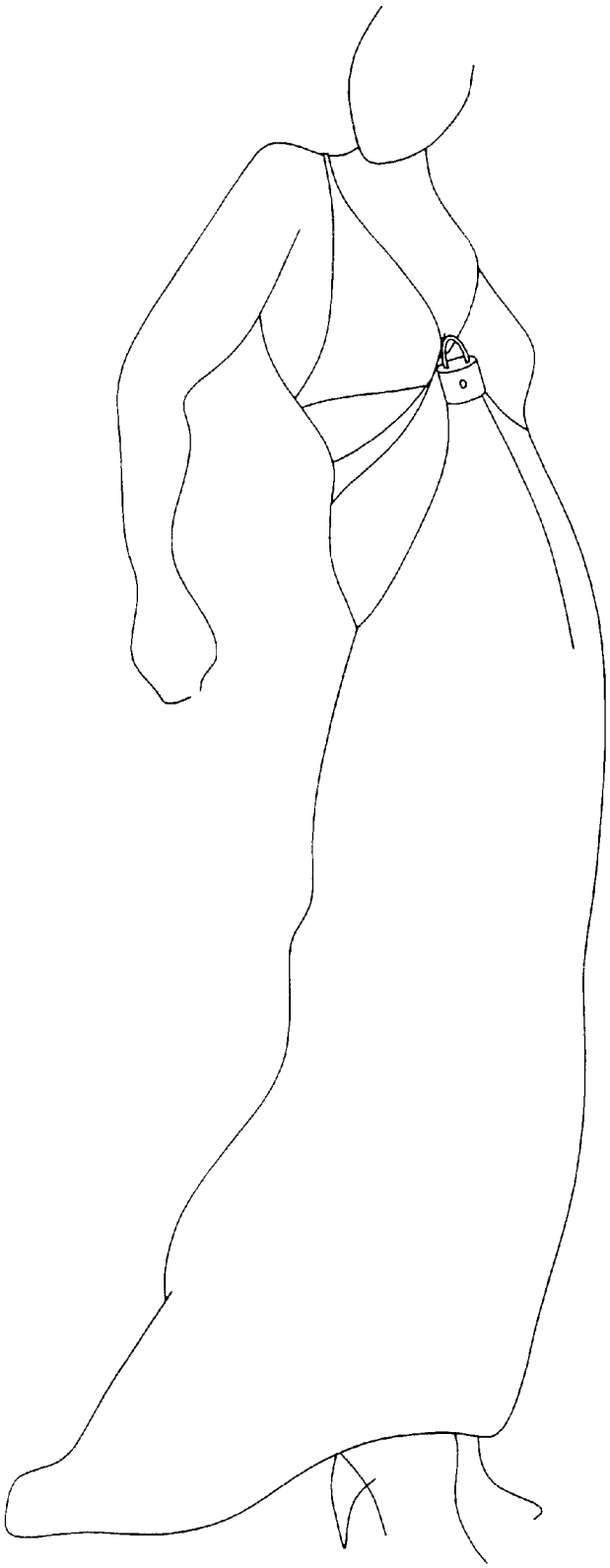
Figure 33:
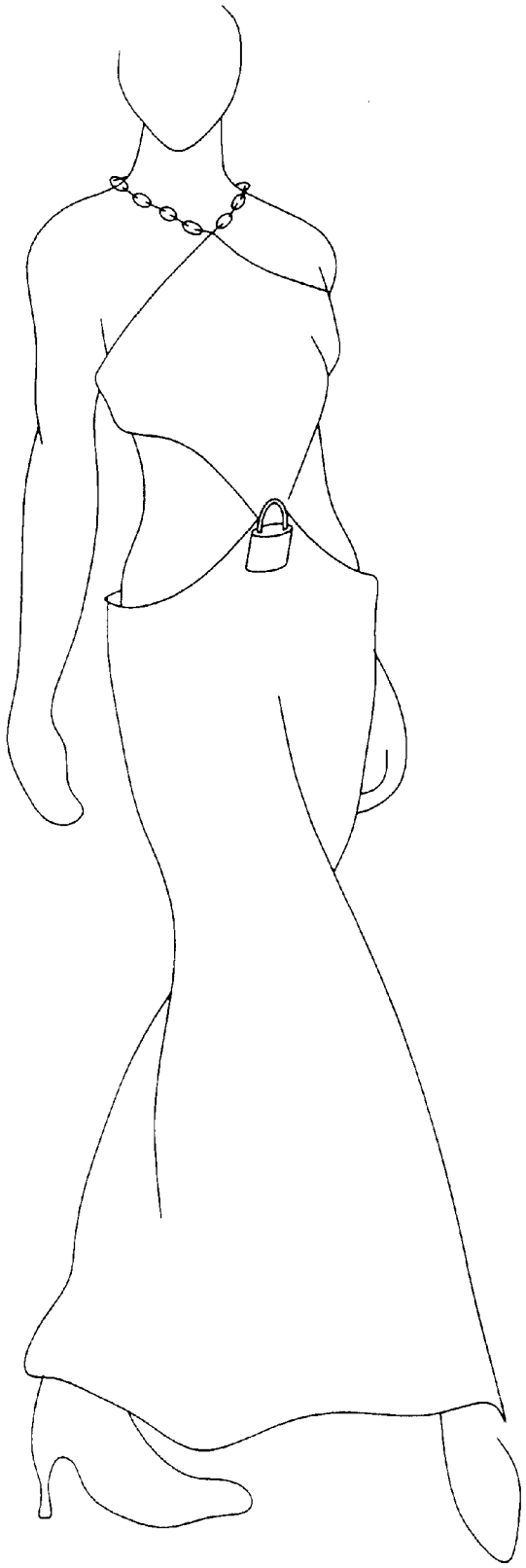

Referring to FIGS. 10–11, the lock handle 12 is thread through a D-ring 24, which itself is thread through a button hole 20. The D-ring 24 can be made of any suitable material, such as, for example, fabric, plastic or metal. This fastening arrangement is especially advantageous for pants or other garments having a point of closure at the belt-line, but can be used for other points of closure and other garments as well. FIG. 10 shows shorts having this fastening arrangement. Unlocking the lock causes the shorts to open or fall away from the body and the garment is held on and in place on the body only if the lock is fastened and locked. FIG. 11 shows a close-up of the fastening arrangement of FIG. 10.

Other embodiments of the present invention are shown in FIGS. 12–33. In all of these embodiments, unlocking the lock causes a garment to open or fall away from the body and a garment is held on and in place on the body only if the lock is fastened and locked.

In accordance with a further embodiment of the present invention, a garment is held to a wearer's body with several closures. A garment in accordance with an embodiment of the present invention can be configured such that the opening of a single closure renders the garment removable from the wearer's body. Alternatively, a garment can be configured such that more than one closure must be opened to render the garment removable from the wearer's body.

Figure 34:
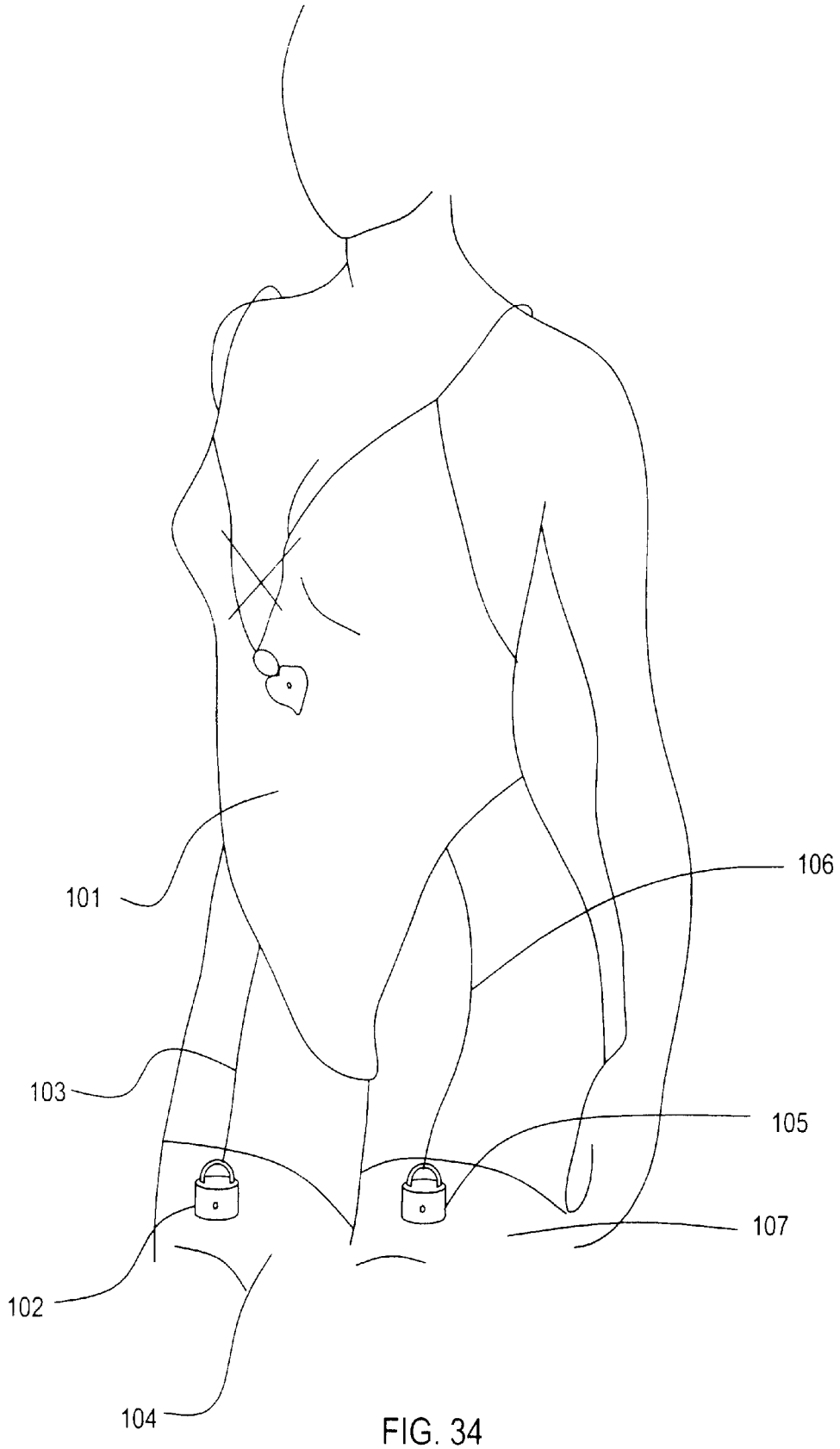
FIG. 34 shows a lingerie body suit having three locks in accordance with an embodiment of the present invention.

FIG. 34 shows a lingerie body suit having three locks in accordance with an embodiment of the present invention. Lock 101 secures a closure between the breasts, thereby keeping the garment in place in the breast area. Lock 102 secures garter 103 to stocking 104. Likewise, lock 105 secures garter 106 to stocking 107. Each of locks 101, 102 and 103 can share the same key, or have different keys.

Figure 35:
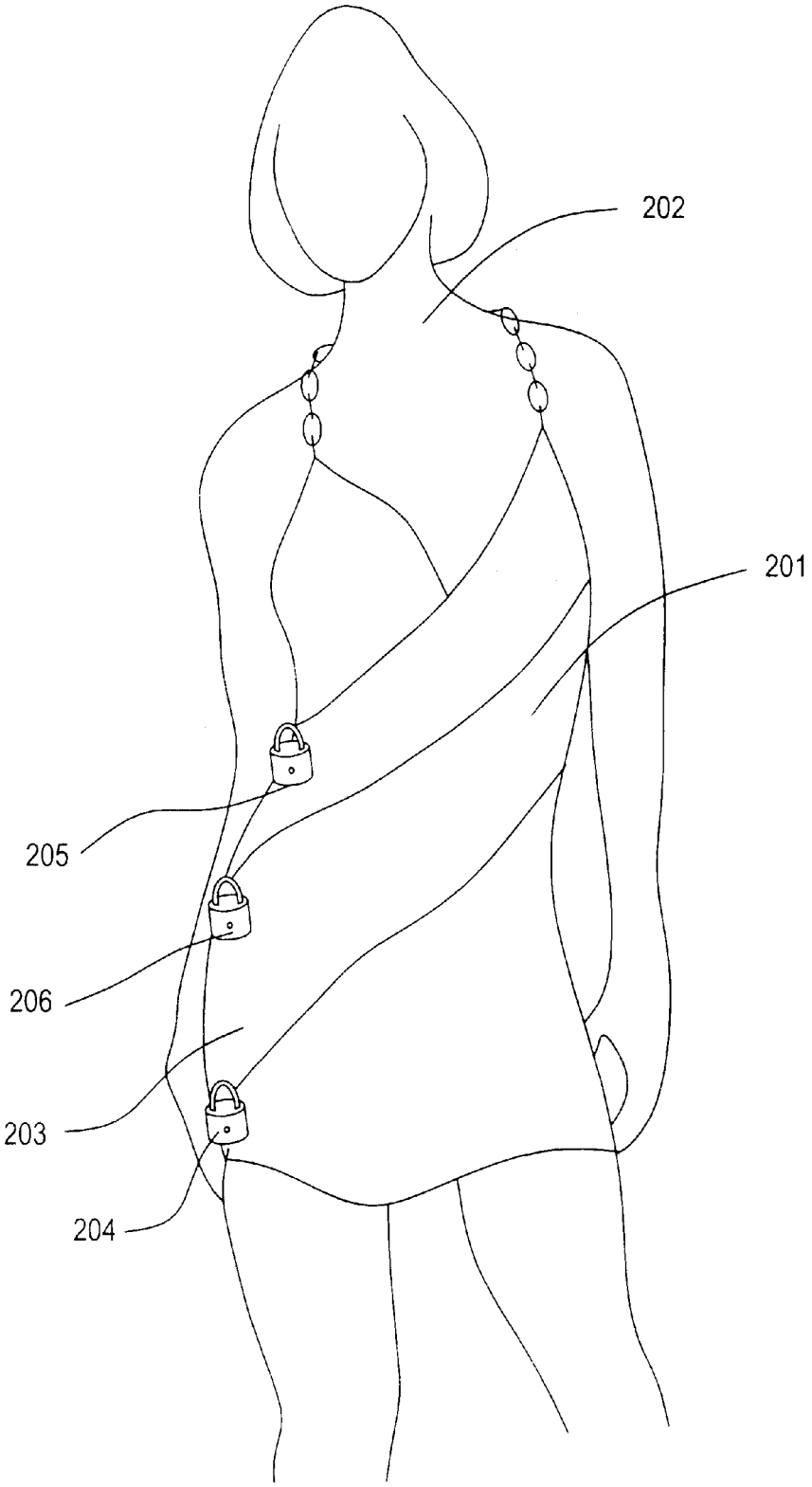
FIG. 35 shows a dress with three locks securing side closures in accordance with an embodiment of the present invention.

FIG. 35 shows a dress with three locks securing side closures in accordance with an embodiment of the present invention. A wrap dress 201 wraps around the body of the wearer 202 to form a closure 203. Locks 204, 205 and 206 secure closure 203 to hold the wrap dress 201 in place on the body of the wearer 202.

Figure 36:
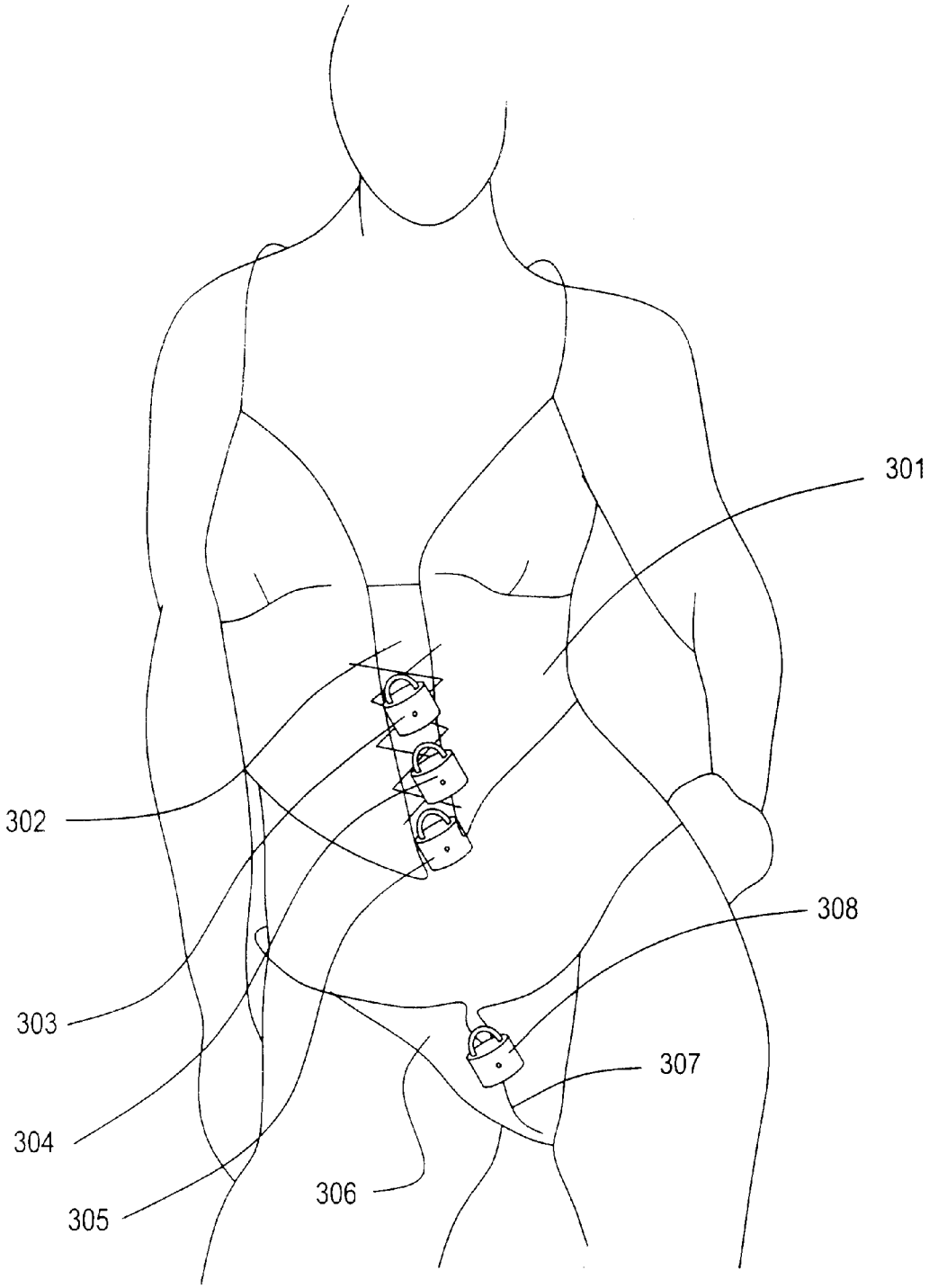
FIG. 36 shows a vest top with three locks securing front closures and an undergarment with a lock securing a front closure in accordance with an embodiment of the present invention.

FIG. 36 shows a vest top with three locks securing front closures and an undergarment with a lock securing a front closure in accordance with an embodiment of the present invention. Vest 301 has closure 302 that is secured by locks 303, 304 and 305, which keep the vest 301 in place over the breast and stomach area. Undergarment 306 has closure 307, which is secured by lock 308. This helps keep the undergarment in its proper position. Locks 303, 304, 305 and 308 can be unlocked to facilitate the removal of these garments.

Figure 37:
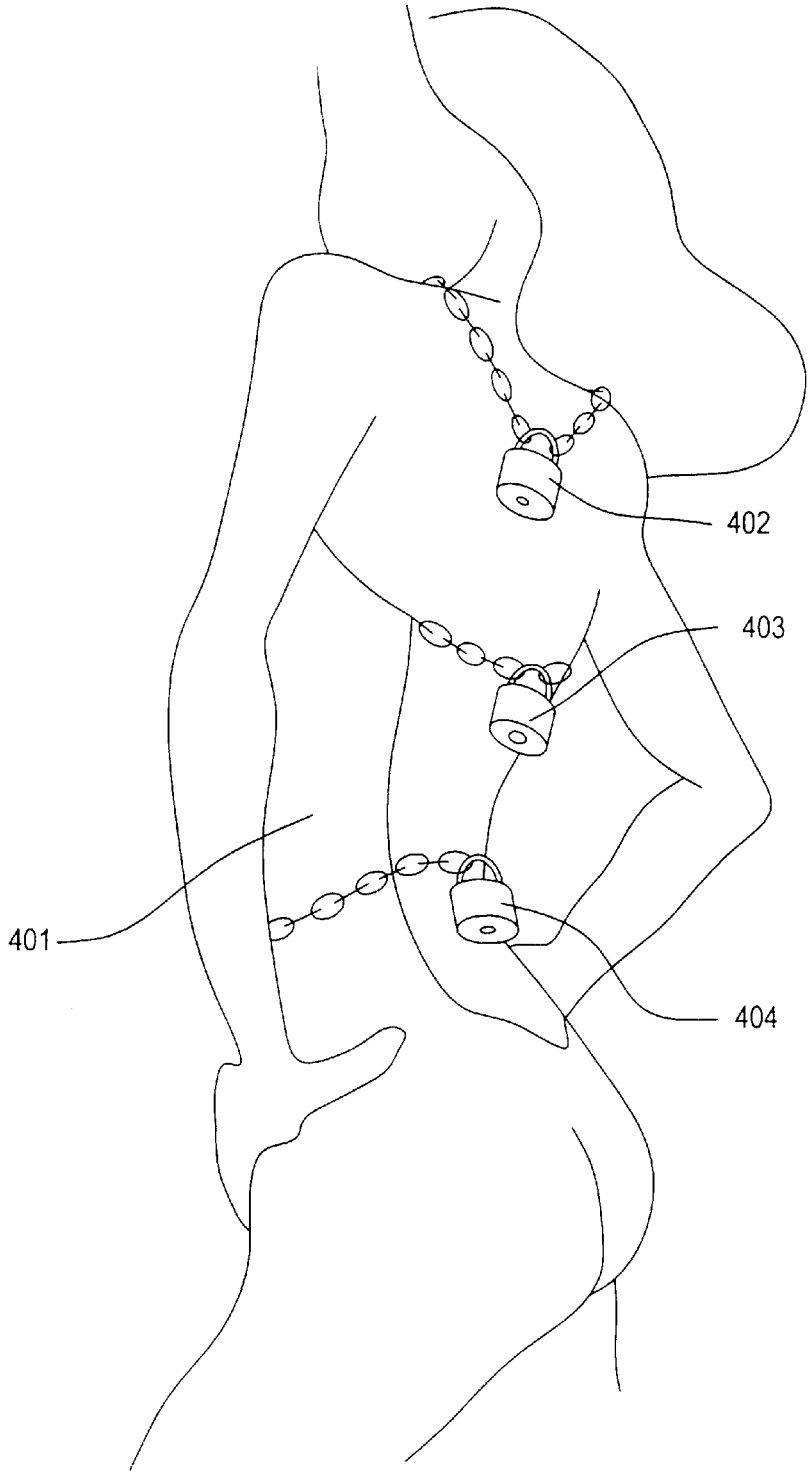
FIG. 37 shows a one-piece body suit secured in place by three chain straps, where each chain strap is secured with a lock in accordance with an embodiment of the present invention.

FIG. 37 shows a one-piece body suit secured in place by three chain straps, where each chain strap is secured with a lock in accordance with an embodiment of the present invention. Body suit (also known as a "cat suit") 401 that is secured to the wearer's body with locks 402, 403 and 404. These help to keep the body suit 401 in place on the wearer's body.

In accordance with an embodiment of the present invention, a garment has two closures. The garment can be removed from the wearer by opening either closure. The first closure is secured with a small padlock. The second closure is secured with a small multi rotor combination lock. In accordance with the present invention, a first person purchases the garment, and is provided with a small key that opens the padlock and a combination which opens the multi rotor lock. The first person dons the garment. In one embodiment, donning the garment requires the first person to unlock one of the locks to enable the garment to be put on, and then securing the lock to hold the garment on the body. In another embodiment, the first person need not unlock and relock any of the locks. For example, in one embodiment, the garment is a dress with two shoulder straps. The padlock secures a first closure at one end of the first shoulder strap to the dress, and the multi rotor lock secures a second closure at one end of the second shoulder strap to the dress. The dress can be donned without unlocking either lock by slipping the dress over the wearer's head.

In accordance with an embodiment of the present invention, the purchaser of the garment can don the garment, and then provide a second person with the key to the padlock; the combination to the multi rotor lock; or both. Alternatively, the wearer of the garment can provide a second person with the key to the padlock and a third person with the key to the multi rotor lock. In this way, keys to locks that secure closures of a garment can be distributed to a plurality of third persons (persons other than the wearer.) For example, the purchaser of the garment can be provided with more than one copy of one or more keys to the locks that secure the garment's closures. The wearer can distribute a first copy of a key to a second person and retain a second copy. The wearer can also distribute a first copy to a first person, a second copy to a second person, and so on. In this embodiment, a closure on the garment can be opened by any one of a plurality of third persons.

In another embodiment, parts of a key can be distributed to a plurality of third persons. For example, a garment in accordance with an embodiment of the present invention includes a closure secured by a three-rotor combination lock that can be opened by setting each of the rotors to a predetermined number. The wearer provides the predetermined number for the first rotor to a first person; the predetermined number for the second rotor to a second person; and the predetermined number for the third rotor to a third person. In this way, the first, second and third persons must collude to open the three-rotor lock on the garment.

The use of one or more locks in accordance with the present invention need not preclude the existence of other known closure securing systems not involving locks on a garment. For example, in one embodiment of the present invention, a dress has a first lock securing a first end of a first shoulder strap to the dress and a second lock securing a first end of a second shoulder strap to the dress. The dress is also provided with a zipper in the back, enabling its wearer to don and remove the dress without regard to whether one or more of the locks is in a locked or unlocked state.

In addition, locks may also be used with accessories worn on the body such as belts, footwear shoes, sandals, boots, scarves, shawls, ties, capes, and hats. For example, for shoes, boots, sandals, or other footwear, which can be held in place or fixed on the body by straps, ties, buckles or overlapping flaps of leather or other material, these closures may be secured by a lock in accordance with the present invention. Also, for ties, scarves, shawls, and capes wrapped, tied or draped around the body, these articles of clothing may be closed or secured in place on the body by a closure such as a buckle, loop, or other form of closure device and secured by a lock. For belts, which may be made out of leather, metal, cloth, plastic or other materials, they may be closed or secured in place by a buckle, loop or other form of closure device secured by a lock.

It is understood that the variations in lock shape, lock mechanism location, point of closure location, or fastening arrangement illustrated in the Figures or described elsewhere in this specification are for illustrative purposes only and that many other variations will be apparent to one skilled in the art. It will also be understood that the specification and Figures are illustrative of the present invention and that other embodiments within the spirit and scope of the invention will suggest themselves to those skilled in the art.

All references cited herein are hereby incorporated by reference.

What is claimed is:

1. An article of clothing comprising:

a body portion for extending around a wearer's body;

a first garment portion comprising a first connector, wherein the first garment portion is connected to the body portion and wherein the first garment portion is configured to at least partially cover a first breast of the wearer;

a second garment portion comprising a second connector, wherein the second garment portion is connected to the body portion and wherein the second garment portion is configured to at least partially cover a second breast of the wearer; and a key-operated lock for securing the first connector with the second connector.

2. The article of clothing of claim 1, wherein the first garment portion comprises:

a first cup for supporting the first breast.

3. The article of clothing of claim 2, wherein the second garment portion comprises:

a second cup for supporting the second breast.

4. The article of clothing of claim 1, further comprising:

a first shoulder strap connected to the body portion and the first garment portion; and a second shoulder strap connected to the body portion and the second garment portion.

5. The article of clothing of claim 1, wherein the key-operated lock is positionable between the first breast and the second breast.

6. The article of clothing of claim 1, wherein the body portion, first garment portion and second garment portion form at least one of a bathing suit, a bra, a tank, a dress, a shirt, and a lingerie top.

7. The article of clothing of claim 1, wherein the garment portion is configured to fall away from the breasts when the key-operated lock is opened.

8. The article of clothing of claim 1, wherein the garment portion is configured to fall away from the breasts when the key-operated lock is removed.

9. The article of clothing of claim 1, wherein the key-operated lock comprises a padlock.

10. The article of clothing of claim 1, wherein the key-operated lock comprises a combination lock.

11. A undergarment top comprising:

a garment portion for covering the breasts of a wearer;

a first connector integrated with the garment portion;

a second connector integrated with the garment portion; and a key-operated lock for securing the first connector with the second connector.

12. The undergarment top of claim 11, wherein the first connector and the second connector form a single closure point for the undergarment top.

13. The undergarment top of claim 11, wherein the garment portion is configured to fall away from the breasts when the key-operated lock is opened.

14. The undergarment top of claim 11, wherein the garment portion is configured to fall way from the breasts when the key-operated lock is removed.

15. The undergarment top of claim 11, wherein the garment portion is constructed to include a single closure point comprising the first connector and the second connector.

16. The undergarment top of claim 11, further comprising:

a first cup connected to the garment portion, the first cup for supporting the first breast.

17. The undergarment top of claim 16, further comprising:

a second cup connected to the garment portion, the second cup for supporting second breast.

* * * * *